US005429192A

United States Patent [19]

Huber et al.

[11] Patent Number: 5,429,192

[45] Date of Patent: Jul. 4, 1995

[54] METHOD AND APPARATUS FOR ANCHORING A PERFORATING GUN TO A CASING IN A WELLBORE INCLUDING A PRIMARY AND A SECONDARY ANCHOR RELEASE MECHANISM

[75] Inventors: Klaus B. Huber; Joe C. Hromas, both of Sugarland; A. Glen Edwards, Hockley, all of Tex.

[73] Assignee: Schlumberger Technology Corporation, Houston, Tex.

[21] Appl. No.: 220,983

[22] Filed: Mar. 30, 1994

Related U.S. Application Data

[63] Continuation-in-part of Ser. No. 57,948, May 5, 1993, Pat. No. 5,366,013, which is a continuation-in-part of Ser. No. 955,816, Oct. 2, 1992, Pat. No. 5,318,126, which is a continuation-in-part of Ser. No. 32,817, Mar. 16, 1993, Pat. No. 5,293,940, which is a continuation of Ser. No. 858,400, Mar. 26, 1992, abandoned.

[51] Int. Cl.[6] ..... E21B 23/01; E21B 43/116

[52] U.S. Cl. ..... 166/297; 166/55.1; 166/217; 166/377; 166/382; 175/4.52

[58] Field of Search ..... 175/4.52; 166/297, 55.1, 166/382, 377, 134, 217

[56] References Cited

U.S. PATENT DOCUMENTS

| | | | |
|---|---|---|---|
| 2,535,342 | 12/1950 | Ahlgren | 166/55.1 X |
| 3,643,737 | 2/1972 | Current et al. | 166/216 |
| 3,912,013 | 10/1975 | Vann | 166/55.1 X |
| 4,336,841 | 6/1982 | Garner, Jr. | 166/216 |
| 4,423,777 | 1/1984 | Mullins et al. | 166/120 |
| 4,526,233 | 7/1985 | Stout | 166/377 |
| 4,531,590 | 7/1985 | Peterson | 175/4.52 |
| 4,544,034 | 10/1985 | George | 166/297 |
| 4,610,300 | 9/1986 | Mullins, II et al. | 166/134 |
| 4,664,188 | 5/1987 | Zunkel et al. | 166/134 |
| 4,815,540 | 3/1989 | Wallbillich, III | 166/377 |
| 5,025,861 | 6/1991 | Huber et al. | 166/297 |
| 5,050,682 | 9/1991 | Huber et al. | 166/377 |
| 5,095,993 | 3/1992 | Huber et al. | 166/382 |
| 5,156,213 | 10/1992 | George et al. | 175/4.52 |
| 5,293,940 | 3/1994 | Hromas et al. | 166/297 |
| 5,318,126 | 6/1994 | Edwards et al. | 166/297 |
| 5,366,013 | 11/1994 | Edwards et al. | 166/297 |

OTHER PUBLICATIONS

A View Into the Future "Monobore Well Completions" Vann Systems Engineered Well Completions, Feb. 1992.

*Primary Examiner*—Hoang C. Dang

*Attorney, Agent, or Firm*—Henry N. Garrana; John H. Bouchard

[57] ABSTRACT

A wellbore tool includes an anchor connected to a perforating gun, the anchor including an anchor slip disposed between upper and lower slip housings for expanding to grip a casing in the wellbore, a primary anchor release mechanism for unsetting the anchor slip and a secondary anchor release mechanism for unsetting the anchor slip when the primary anchor release mechanism is not activated. If the primary and secondary anchor release mechanisms have not been activated, the anchor slip can be set. The primary anchor release mechanism automatically unsets the anchor slip when a detonation wave, conducting in a detonating cord, propagates through an interior space of a frangible member, the detonation wave shattering the frangible member and detonating the perforating gun. When the frangible member is shattered, the anchor slip can then be unset thereby allowing the perforating gun to fall to a bottom of the wellbore. A secondary anchor release mechanism can be used to unset the anchor when the primary anchor release mechanism is not being used. The secondary anchor release mechanism includes a release sleeve adapted to attach to a separate shifting tool, an upset, and a collet finger. A movement of the shifting tool will cause the release sleeve and the upset to move away from the collet finger. When the upset moves away from the collet finger, the anchor slip can be unset without shattering the frangible member of the primary mechanism or detonating the perforating gun.

32 Claims, 16 Drawing Sheets

| |
|---|
| FIG. 8a |
| FIG. 8b |
| FIG. 8c |
| FIG. 8d |

| |
|---|
| FIG. 9b |
| FIG. 9d |

METHOD AND APPARATUS FOR ANCHORING A PERFORATING GUN TO A CASING IN A WELLBORE INCLUDING A PRIMARY AND A SECONDARY ANCHOR RELEASE MECHANISM

CROSS REFERENCE TO RELATED APPLICATIONS

This application is a continuation in part of a first application Ser. No. 08/057,948 filed May 5, 1993, now U.S. Pat. No. 5,366,013, which first application is a continuation in part of a second application Ser. No. 07/955,816 filed Oct. 2, 1992, now U.S. Pat. No. 5,318,126, which second application is a continuation in part of a third application Ser. No. 08/032,817 filed Mar. 16, 1993, now U.S. Pat. No. 5,293,940, which third application is a continuation of a fourth application Ser. No. 07/858,400 filed Mar. 26, 1992, now abandoned.

BACKGROUND OF THE INVENTION

The subject matter of the present invention relates to an anchor apparatus adapted to be disposed in a wellbore and a method for releasing the anchor and dropping a perforating apparatus when a frangible member is shattered in response to a detonation wave propagating in a detonating cord, and more particularly, to an anchor apparatus and a method for propagating a detonation wave in a detonating cord, shattering a frangible member in response to the detonation wave, unsetting the anchor apparatus from a wall of the wellbore using a primary release mechanism when the frangible member shatters, unsetting the anchor apparatus using a secondary release mechanism when the primary release mechanism is not used, and, when the anchor apparatus is unset, dropping the perforating apparatus to a bottom of the wellbore.

In U.S. Pat. No. 5,293,940 automatic tubing release apparatus adapted to be disposed in a wellbore includes a frangible member and enclosed detonating cord. The frangible member shatters when a detonation wave, propagating in the detonating cord, passes through the frangible member. Before the frangible member shatters, a perforating apparatus is connected to a tubing. However, when the frangible member shatters, the perforating apparatus is automatically released from the tubing and the perforating apparatus falls to a bottom of the wellbore.

In U.S. Pat. No. 5,318,126, which is a continuation in part of the aforementioned U.S. Pat. No. 5,293,940, an explosively opened production valve adapted to be disposed in a wellbore includes the same frangible member with enclosed detonating cord adapted to conduct a detonation wave. The production valve is initially disposed in one state (e.g., a closed state). However, when the frangible member shatters in response to the detonation wave, conducting in the detonating cord, passing through the frangible member, the production valve changes from the one state to another state (e.g., an open state).

In U.S. Pat. No. 5,366,013, which is a continuation in part of the aforementioned U.S. Pat. No. 5,318,126, a shock absorber adapted to be disposed in a wellbore includes the same frangible member with enclosed detonating cord adapted to conduct a detonation wave. The shock absorber initially cannot absorb shock. However, when the frangible member shatters in response to the detonation wave passing through the frangible member, the shock absorber is then ready to absorb shock.

In all of the aforementioned applications, a detonating cord is enclosed by a frangible member. When a detonation wave propagates within the detonating cord, the detonation wave passes through the interior of the frangible member.

In response to the detonation wave, the frangible member shatters. When the frangible member shatters, an event occurs. For example, in the aforementioned patent, a perforating gun will be automatically released from a tubing, or a production valve will change state, or a shock absorber will be ready to absorb shock. However, none of the aforementioned applications disclose a novel anchor apparatus including the automatic release of the anchor when the frangible member shatters in response to the detonation wave passing through the frangible member.

U.S. Pat. No. 5,025,861 to Huber et al, and associated divisional U.S. Pat. Nos. 5,095,993 and 5,050,682, disclose an apparatus including a perforating gun and an anchor for anchoring the perforating gun to a casing prior to detonating the perforating gun. In these Huber et al patents, two interleaved coil springs having beveled shaped surfaces comprise the anchor. Compression of the inner coil spring forces a radial expansion of the outer coil spring. When the perforating gun detonates, the gun remains anchored to the casing. The anchor can be released by a slickline manual operation or by an automatic operation by high order detonation of the perforating gun. In the slickline manual operation, a separate shifting tool, connected to a shifting profile of the anchor, pulls upwardly on the fishing profile and releases the anchor from the casing. As a result, after the perforating gun detonates, a separate action is required to release the anchor from the casing. While this anchor is sufficient for some purposes, a novel monobore anchor is needed for monobore completion situations in a wellbore. The term "monobore completion" refers to a single diameter of casing and a single diameter of tubing throughout the entire length of a wellbore. The new monobore anchor would include a new anchor apparatus and a new redundant unsetting apparatus for unsetting the anchor. For example, a primary unsetting apparatus would automatically unset the anchor from the casing in response to a detonation wave propagating through a detonating cord on its way to the perforating gun. As a result, in order to unset the anchor, no separate action would be required by an operator, and the previously required overshot and fishing profile would not be needed.

U.S. Pat. No. 4,815,540 to Wallbillich III and U.S. Pat. No. 4,526,233 to Stout disclose an apparatus for releasing a perforating gun from a tubing. In both of these patents, the perforating gun is secured to the tubing by a latch mechanism. When the perforating gun discharges, the latch mechanism ultimately releases the gun from the tubing. In the Wallbillich patent, following detonation of the perforating gun, a ball must first fall to a seat and tubing pressure must be increased in order to effect release of the latch mechanism. In the Stout patent, following detonation of the perforating gun, gas pressure produced from detonation of the perforating gun must be relied upon to effect release of the latch mechanism and release of the perforating gun from the tubing. However, none of the aforementioned patents automatically release an anchor thereby releasing a perforating gun from a casing when a detonation wave, propagating in a detonating cord, shatters a frangible member and nearly simultaneously detonates the perforating gun.

SUMMARY OF THE INVENTION

Accordingly, it is a primary object of the present invention to provide a wellbore tool adapted to be disposed in a wellbore having an anchor apparatus which includes means for expanding an anchor slip and gripping a wellbore casing, and a primary anchor release mechanism for automatically releasing the anchor slip from the casing when a frangible member shatters in response to a detonation wave propagating in a detonating cord.

It is a further object of the present invention to provide a wellbore tool adapted to be disposed in a wellbore having an anchor apparatus which includes means for expanding an anchor slip and gripping a wellbore casing, a primary anchor release mechanism for automatically releasing the anchor slip from the casing when a frangible member shatters in response to a detonation wave propagating in a detonating cord, and a secondary anchor release mechanism involving an alternate method and apparatus for releasing the anchor slip from the casing in the event the frangible member is not shattered.

It is a further object of the present invention to provide a wellbore tool adapted to be disposed in a wellbore including an anchor apparatus having an anchor slip which expands to grip a casing of the wellbore when the wellbore tool is disposed in the wellbore and a primary anchor release mechanism for automatically unsetting the anchor slip when a detonation wave propagates within a detonating cord, shatters a frangible member and detonates a perforating gun.

It is a further object of the present invention to provide the wellbore tool adapted to be disposed in a wellbore further including an anchor apparatus having an anchor slip which expands to grip a casing of the wellbore when the wellbore tool is disposed in the wellbore and a secondary anchor release mechanism involving an alternate method and apparatus for unsetting the anchor slip when a detonation wave did not propagate within a detonating cord, did not shatter the frangible member, and did not detonate the perforating gun.

In accordance with these and other objects of the present invention, a wellbore tool adapted to be disposed in a wellbore comprises an anchor apparatus including an anchor slip, means for expanding the anchor slip to an expanded position where it grips a casing in the wellbore when the wellbore tool is disposed in the wellbore, a primary anchor release mechanism for unsetting the anchor apparatus and releasing the anchor slip from its expanded position, and a secondary anchor release mechanism for unsetting the anchor apparatus in the event the primary anchor release mechanism is not utilized.

The anchor apparatus includes a top sub, a ratchet ring retainer connected to the top sub, an outer sleeve connected to the ratchet ring retainer, an intermediate housing connected to the outer sleeve, an upper slip housing connected to the intermediate housing, a lower slip housing, and an anchor slip disposed between the upper slip housing and the lower slip housing. A setting tool adaptor (connection means) is enclosed by the top sub. The anchor apparatus is physically connected to a perforating gun for anchoring the perforating gun to the wellbore casing.

An anchor setting apparatus, which is adapted to connect to the anchor apparatus, includes a setting tool having an inner and outer part. The outer part of the setting tool includes an outer setting tool adaptor sleeve which is adapted to contact the top sub of the anchor apparatus. The inner part of the setting tool includes an inner setting tool adaptor. The inner setting tool adaptor further includes a tension stud and collapsible collet fingers which are adapted to connect to the setting tool adaptor (connection means) of the anchor apparatus.

Functionally, in order to set the anchor apparatus leaving the perforating gun anchored to the casing in the wellbore, the top sub is pushed downwardly while the tension stud, collapsible collet fingers, and connection means remains fixed in position. This produces a pulling force on the tension stud. When enough pulling force is applied to the tension stud, two things will happen. First, the ratchet ring retainer, the outer sleeve, the intermediate housing, and the upper slip housing will move downwardly while the lower slip housing remains fixed in position. As a result, the anchor slip will expand radially outwardly to its expanded position where it grips the wellbore casing. The anchor is now set and the perforating gun is anchored to the wellbore casing. Second, after the anchor is set, continued downward movement of the top sub relative to tension stud, collet fingers and connection means will completely sever the tension stud. When the tension stud severs, the collet fingers will collapse. When the collet fingers collapse, the collet fingers will be released from the connection means of the anchor apparatus. When the collet fingers are released from the connection means, the anchor setting apparatus may be withdrawn to the surface of the wellbore, and a large opening will appear in the top part of the anchor apparatus. The perforating gun is now standing alone, anchored by the anchor apparatus to the wellbore casing.

The anchor apparatus of the present invention includes a primary and secondary anchor release mechanism. The primary anchor release mechanism includes a frangible member and a detonating cord disposed within the frangible member and connected to a perforating gun. When a detonation wave propagates within the detonating cord, the detonation wave will shatter the frangible member and then detonate the perforating gun. When the frangible member shatters, the anchor apparatus will automatically unset from its set condition whereupon the anchor will release its grip from the wellbore casing. The secondary anchor release mechanism will unset the anchor without shattering the frangible member and detonating the perforating gun. A separate running tool known as a shifting tool or a stinger tool is run into the wellbore and is inserted into the aforementioned large opening in the top part of the anchor apparatus. The shifting tool is adapted to attach to a release sleeve of the anchor apparatus. A pull or a push on the shifting tool will cause a separate upset to move out from under a collet finger. This action will cause the anchor apparatus to unset from the casing without also shattering the frangible member or detonating the perforating gun.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 15*a*–15*c* illustrate a release sleeve jarred down and fingers released, and FIGS. 14*a*–14*c* illustrate the anchor slip retracting when the fingers of FIGS. 15*a*–15*c* are released.

DETAILED DESCRIPTION OF THE PREFERRED EMBODIMENT

Figure 1:
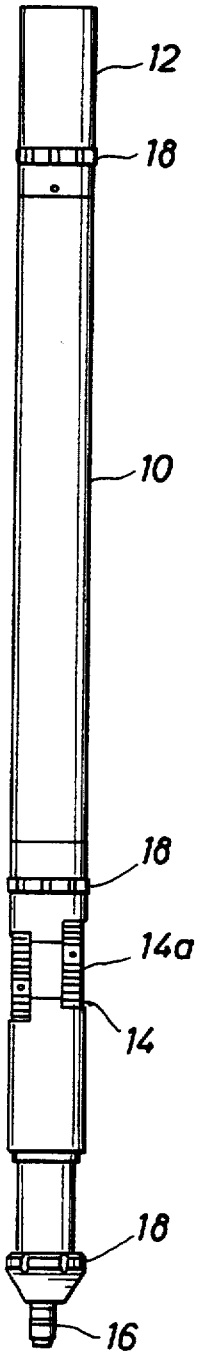
FIG. 1 illustrates the wellbore tool of the present invention including a top sub adapted for connection to a separate anchor setting apparatus, an anchor apparatus of the present invention including anchor slips, a gun adaptor adapted to be connected to a perforating gun, and an anchor release mechanism enclosed by the anchor slips.

Referring to FIG. 1, a wellbore tool of the present invention adapted to be disposed in a wellbore is illustrated. In FIG. 1, the tool includes a housing 10, a top sub 12 adapted to be connected to an anchor setting apparatus, an anchor 14 having slips 14*a*, a gun adapter 16 adapted to be connected to a perforating gun, and gauge rings 18 including an upper gauge ring, a middle gauge ring, and a lower gauge ring. In FIG. 1, the anchor setting apparatus pushes downwardly on the top sub 12. In response, the anchor slips 14*a* expand radially outwardly until the slips 14*a* contact a wall of a wellbore casing. A continued push downward on the top sub 12 by the anchor setting apparatus will cause the slips 14*a* to firmly grip the casing wall thereby setting the anchor 14.

Figure 2:
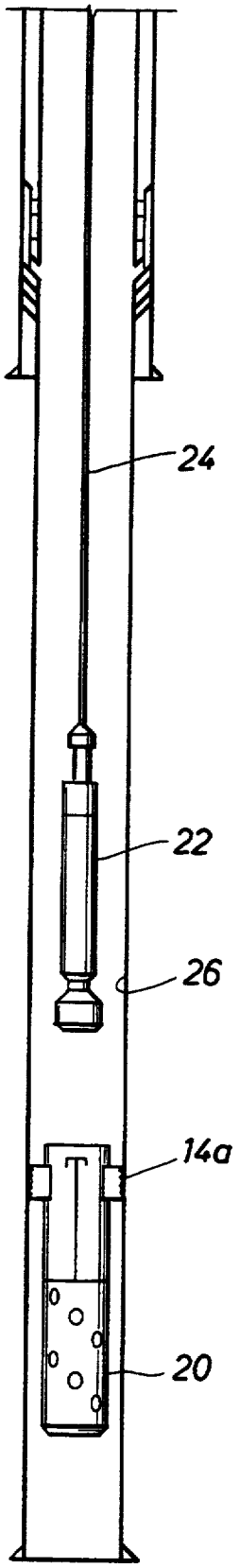
FIGS. 2 and 3 illustrate the anchor apparatus of FIG. 1 in a set condition, the anchor apparatus being anchored to the casing of a wellbore and the anchor setting apparatus withdrawing from the wellbore.

Referring to FIG. 2, the gun adapter 16 is connected to a perforating gun 20 and the slips 14*a* are shown firmly gripping the casing wall. An anchor setting apparatus 22, suspending by a wireline 24 when the wellbore tool of figure I is disposed in a wellbore 26, is connected to the top sub 12 of the wellbore tool of FIG. 1. When the anchor setting apparatus 22 pushes downwardly on the top sub 12, the slips 14 expand radially outwardly until they firmly grip a wall of the wellbore 26. However, when the upward pull of the inner section of the anchor setting apparatus 22 exceeds a predetermined limit placed on the apparatus 22, as shown in FIG. 2, the anchor setting apparatus 22 will separate from the anchor 14, slips 14*a*, and the perforating gun 20. However, the slips 14*a* will remain in contact with the casing wall of wellbore 26 and the perforating gun 20 will remain anchored to the casing wall by anchor 14.

Figure 3:
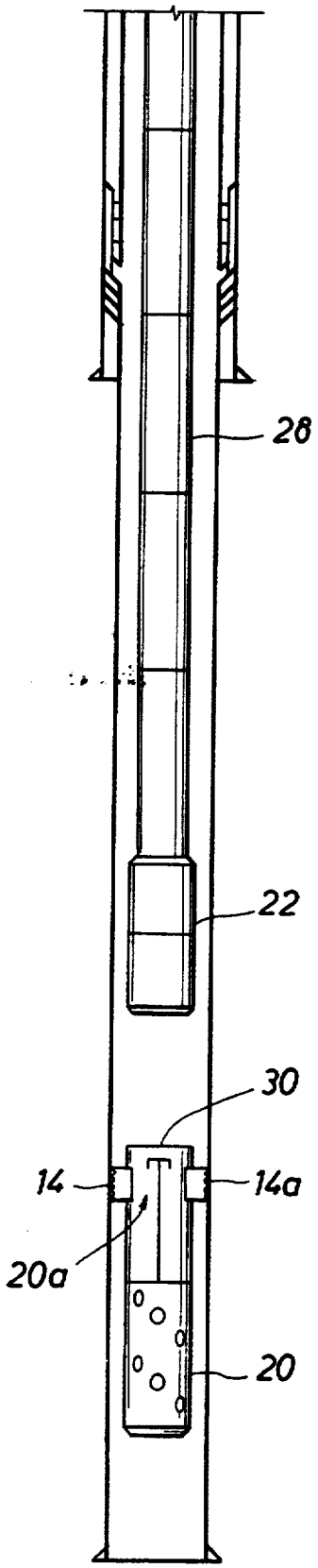

In FIG. 3, the anchor setting apparatus 22 is again shown separated from the anchor 14, slips 14*a* and perforating gun 20. The anchor setting apparatus 22 is shown in FIG. 3 as suspending by a tubing string 28 and not by the wireline 24. When the anchor setting apparatus 22 of FIGS. 2 and 3 separates from the anchor 14 and perforating gun 20 as shown in FIGS. 2 and 3, a large opening 30 is left on the top of the gun 20, the opening being illustrated by numeral 30 in FIG. 3. The large opening 30 is large enough to enable a "shifting tool" to enter the gun 20, attach itself to a release sleeve, and access the firing head 20*a* of the perforating gun 20, which is illustrated by numeral 72 in FIGS. 8*a*–8*b* and will be discussed in more detail later in this specification. When the stinger tool pulls upwardly or pushes downwardly on the release sleeve, the slips 14*a* of anchor 14 may be unset and released from the casing wall of wellbore 26 without shattering the frangible member referenced earlier in this specification. The movement of the release sleeve and the unsetting of the anchor 14 will be discussed in more detail later in this specification.

Figure 4:
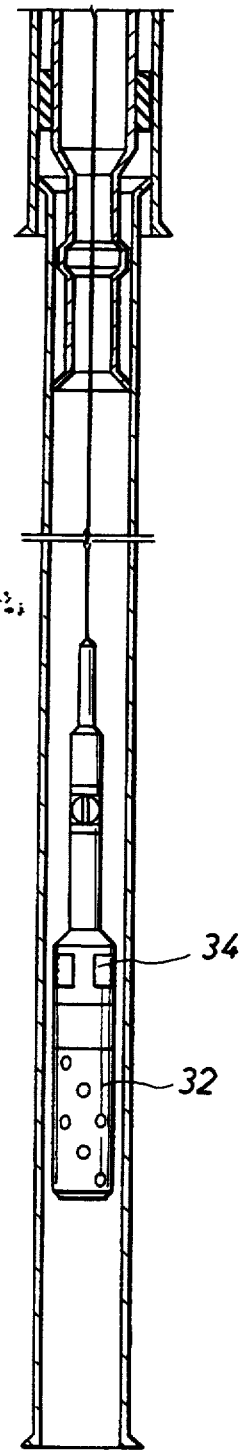
FIG. 4 (PRIOR ART)
FIGS. 4–5 illustrate a prior art anchor setting apparatus, shown in FIG. 5 in a set condition, that is disclosed in U.S. Pat. No. 5,025,861 to Huber et al, including associated divisional U.S. Pat. Nos. 5,095,993 and 5,050,682 to Hubor et al, the anchor of FIG. 5 remaining in the set condition even after the perforating apparatus is detonated until a separate shifting tool is used to unset the anchor.
Figure 5:
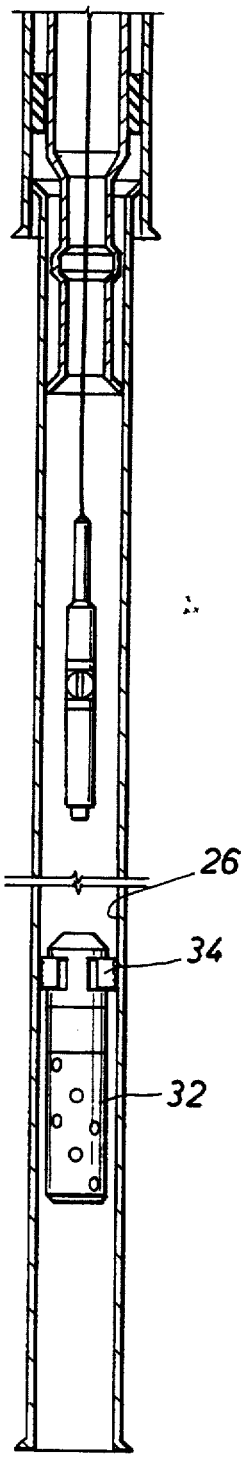
FIG. 5 (PRIOR ART)
Figure 6:
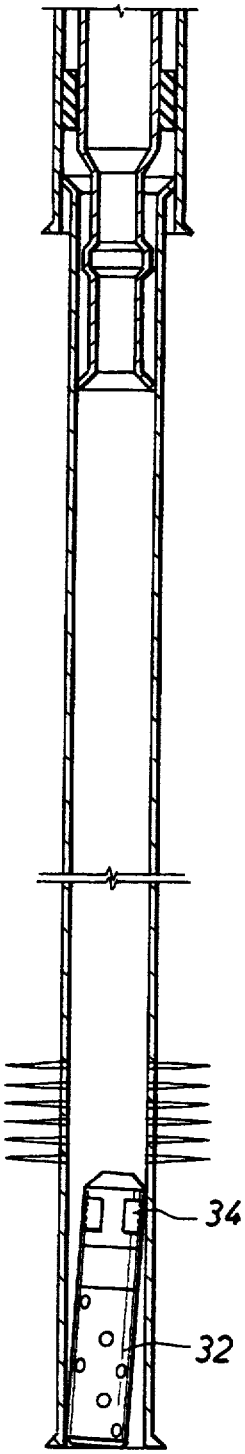
FIG. 6 (PRIOR ART)
FIG. 6 illustrates the prior art anchor setting apparatus of FIGS. 4–5 where the anchor is shown unset and the perforating gun is resting on a bottom of the wellbore.

Referring to FIGS. 4–6, a prior art technique for anchoring a perforating gun to a casing in a wellbore is illustrated. This prior art technique is disclosed in U.S. Pat. No. 5,025,861 to Huber et al, the disclosure of which is incorporated herein by reference.

In FIG. 4, the perforating gun 32 has been lowered into the wellbore and an anchor setting apparatus will set the anchor 34. In FIG. 5, the anchor setting apparatus has already set the anchor 34 and has separated itself from the anchor 34 and the perforating gun 32. The perforating gun 32 will stand alone, anchored to the casing 26 of the wellbore. After the perforating gun 32 detonates, a separate action is required to release the anchor 34 from casing 26. In the separate action required by an operator at the wellbore surface, a shifting tool having profile keys must be lowered into the wellbore and must be physically connected to a fishing profile of a release sleeve disposed within the anchor 34. Pulling up on the release sleeve will release the anchor 34 which allows the perforating gun 32 to fall to a bottom of the wellbore. FIG. 6 illustrates the perforating gun 32 resting on a bottom of the wellbore.

However, instead of releasing the anchor via the above referenced separate action which must be taken after the perforating gun detonates, it would be more convenient to "automatically" release or unset the anchor from the wellbore casing immediately after the detonation of the perforating gun, the automatic release taking place without any separate action required by an operator at the wellbore surface.

Figure 7:
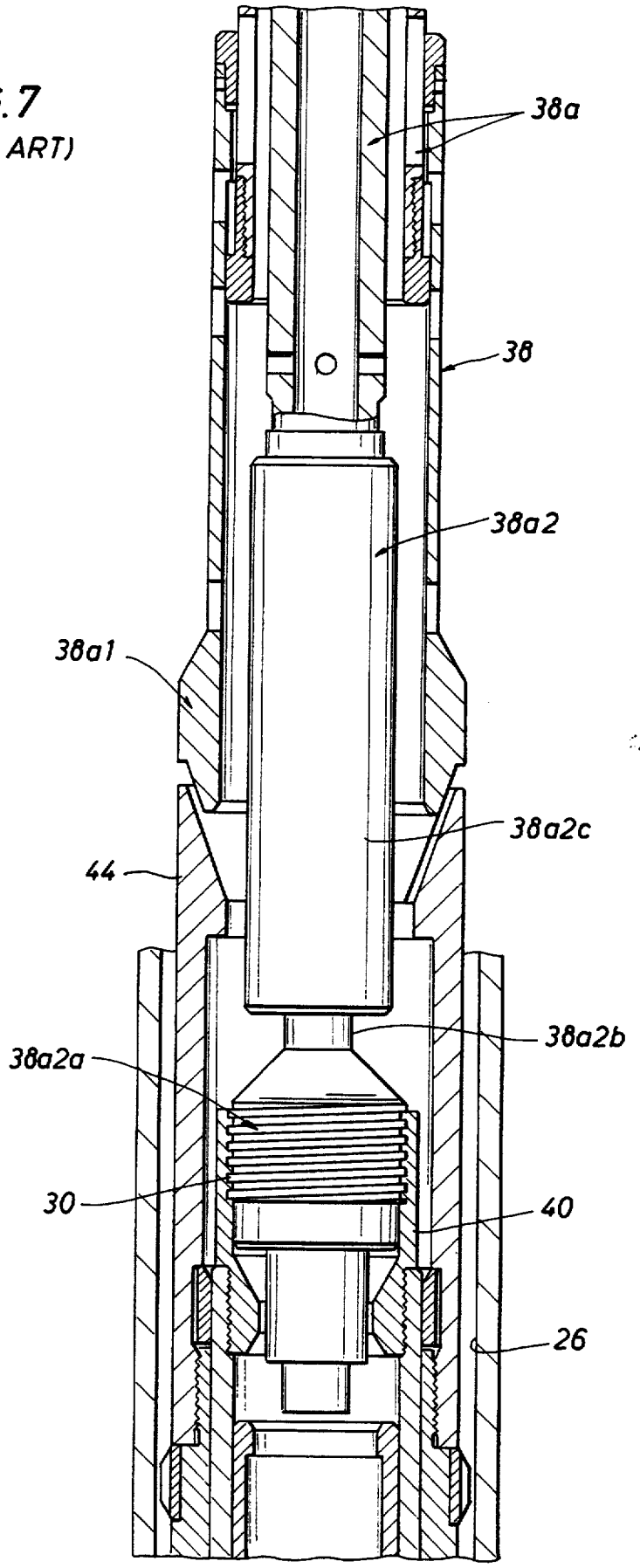
FIG. 7 (PRIOR ART)
FIG. 7 illustrates a prior art construction of a portion of a setting tool when it is connected to a connection means of the wellbore tool of the present invention for setting the anchor.

Referring to FIG. 7, a portion of a prior art anchor setting apparatus 38 is shown connected to a setting tool adaptor 40 of the wellbore tool of the present invention (also referred to below as a connection means 40) which is enclosed by an anchor top sub 44 of an anchor apparatus of the present invention. The anchor setting apparatus 38 sets an anchor 42 (in FIG. 8c), and, when set, the anchor 42 firmly grips the wellbore casing 26.

In FIG. 7, the portion of the anchor setting apparatus 38 includes the setting tool 38a having an inner part and an outer part. The outer part of the setting tool 38a includes an outer setting tool adapter sleeve 38a1 which is adapted to contact the anchor top sub 44 of the anchor apparatus. The inner part includes an inner setting tool setting adaptor 38a2 which is adapted to connect to the connection means 40 of the anchor apparatus. The inner setting tool adaptor 38a2 has an adaptor portion 38a2c which is connected to an end portion 38a2a via a smaller diameter middle portion 38a2b. The end portion 38a2a includes a plurality of collapsible collet fingers which are adapted to connect to the connection means 40 of the anchor apparatus. When the collet fingers collapse, the end portion 38a2a will disconnect from the connection means 40. When the end portion 38a2a separates from the connection means 40 in FIG. 7, the anchor setting apparatus 22 of FIGS. 2 and 3 can be raised upwardly to the wellbore surface leaving the perforating gun 20 standing alone, anchored to the wellbore casing 26. The inner setting tool adaptor 38a2 includes the adaptor portion 38a2c and the end portion 38a2a which actually comprises a plurality of collapsible collet fingers 38a2a. The adaptor portion 38a2c includes a tension stud, and the tension stud includes a recess located in the middle part of the tension stud. The setting tool 38a of FIG. 7 is adapted to connect to threaded end portions of the setting tool adaptor 38a2. When enough pulling force is applied to the tension stud of the setting adaptor 38a2 by the setting tool 38a, the tension stud severs at the recess, and allows the collapsible collet fingers 38a2a to collapse and release from the connection means 40 associated with the anchor 42 of the anchor apparatus of FIG. 7. When the collet fingers 38a2a are released from the connection means 40, the large opening 30 (of FIG. 3) remains within the open center part of the connection means 40. The large opening 30 allows a shifting tool to access the shifting profile 56a of FIG. 8a for the purpose of activating the secondary anchor release mechanism associated with one aspect of the present invention. When the collapsible collet fingers are released from the connection means 40, the anchor setting apparatus 22 of FIGS. 2 and 3 can be raised upwardly to the wellbore surface leaving the perforating gun 20 standing alone, anchored to the wellbore casing 26.

Referring to FIGS. 8a–8d, a detailed construction of the wellbore tool of FIG. 1 of the present invention is illustrated. The wellbore tool of FIG. 1 includes a novel anchor apparatus including an anchor slip which expands to grip a casing in the wellbore, a primary anchor release mechanism for unsetting the anchor apparatus by shattering a frangible member, and a secondary anchor release mechanism involving an alternate method and apparatus for unsetting the anchor apparatus without utilizing the primary anchor release mechanism.

Figure 8A:
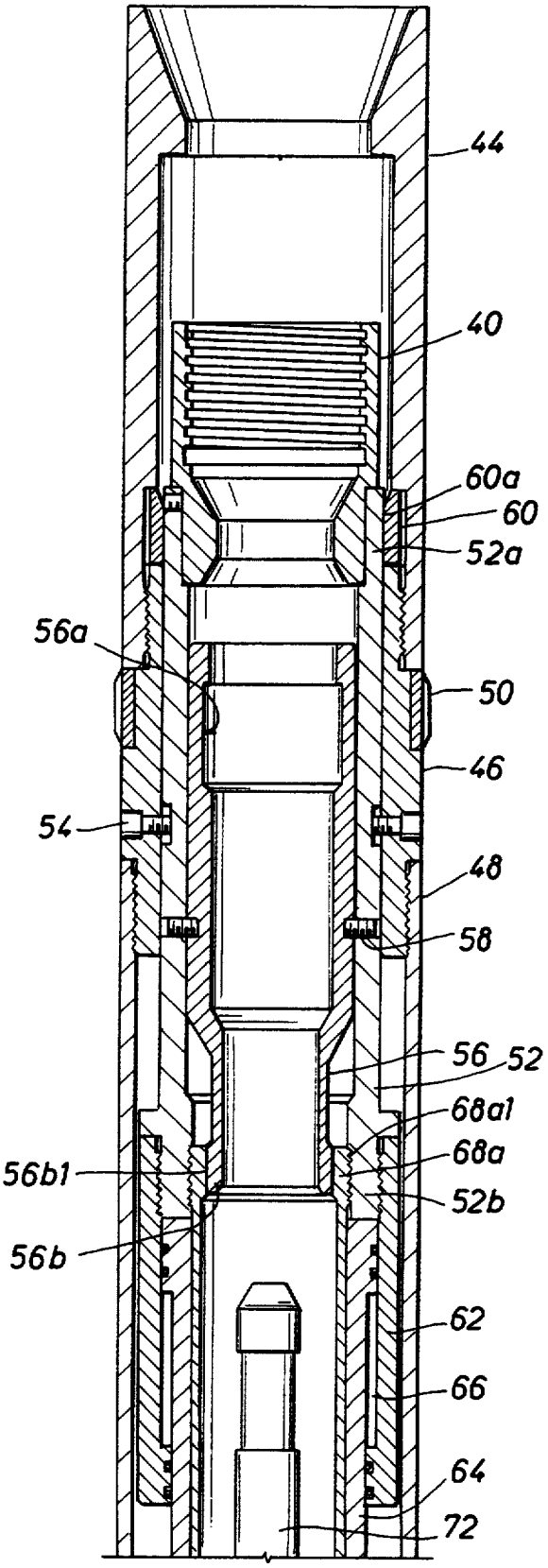
FIGS. 8*a*–8*d* illustrate a detailed construction of the wellbore tool of the present invention including: an anchor apparatus of the present invention including an anchor slip for expanding to grip a casing, a primary anchor release mechanism of the present invention for unsetting the anchor apparatus and releasing the anchor slip from the casing by shattering a frangible member, and a secondary anchor release mechanism involving an alternate method and apparatus for releasing the anchor slip from the casing without shattering the frangible member.
Figure 8B:
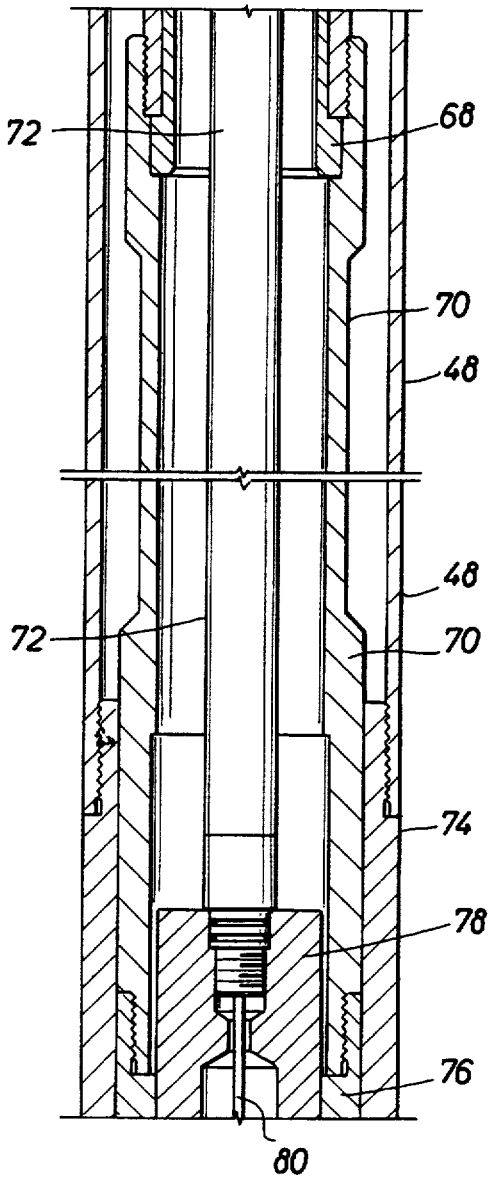
Figure 8C:
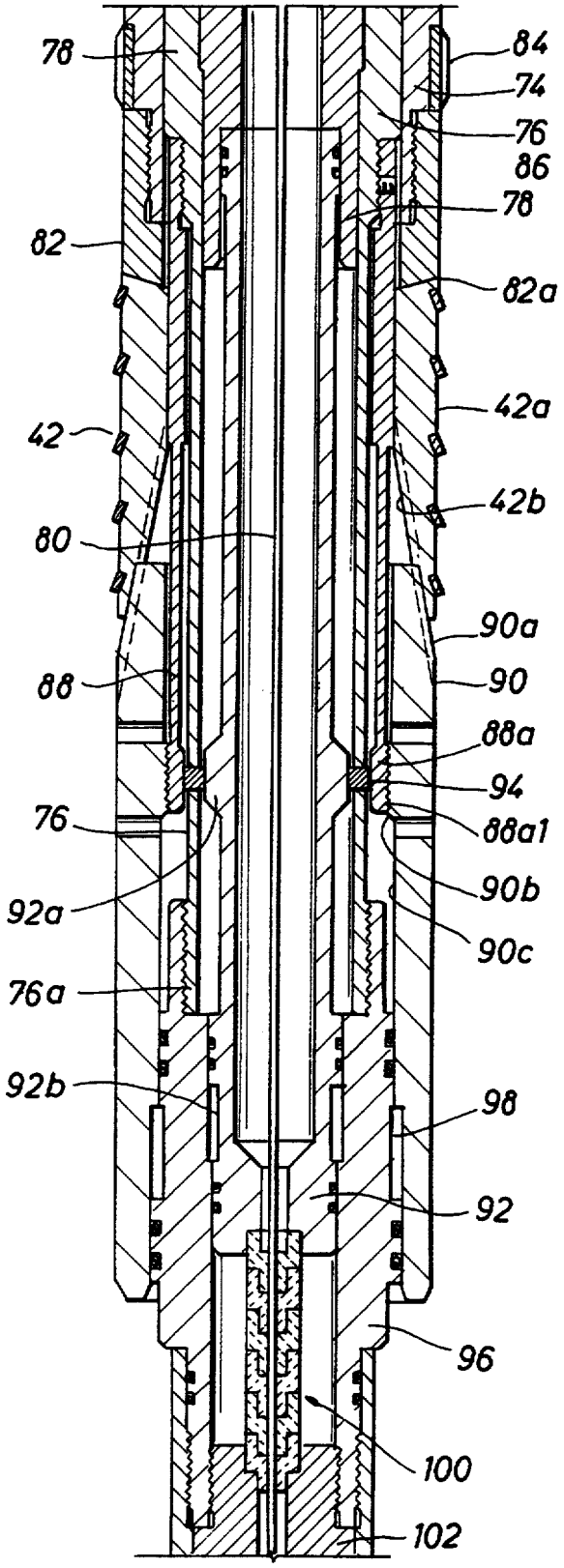

In FIGS. 8a–8d, the anchor apparatus includes the top sub 44 in FIG. 8a threadedly connected to the ratchet ring retainer 46. The ratchet ring retainer 46 is threadedly connected to outer sleeve 48. In FIG. 8b, the outer sleeve 48 is threadedly connected to the intermediate housing 74. In FIG. 8c, the intermediate housing 74 is threadedly connected to the upper slip housing 82.

A lower slip housing 90 is disposed below the upper slip housing 82, and a slip 42a associated with an anchor 42 is disposed between the upper slip housing 82 and the lower slip housing 90. The slip 42a includes a beveled surface 42b. The lower slip housing 90 also includes a beveled surface 90a which is adapted to intermeshingly slide across the beveled surface 42b of the anchor slip 42a. When the top sub 44 of FIG. 8a is pushed downwardly while the setting tool adaptor (connection means) 40 remains fixed in position in response to the function of the setting tool 38a of FIG. 7, the upper slip housing 82 begins to physically approach the lower slip housing 90. Recall that the wellbore tool of the present invention includes a primary and second anchor release mechanism for unsetting the anchor. Since the anchor slip 42a is disposed between the upper and lower slip housings 82 and 90, when the upper slip housing 82 physically approaches the lower slip housing 90 and the primary and secondary anchor release mechanisms have not been activated (and the anchor cannot unset), the beveled surfaces 42b and 90 a of the slip 42a and lower slip housing 90 begin to intermeshingly slide across one another. As a result, the slip 42a is forced to expand radially outwardly in FIG. 8c.

In FIG. 8a, the secondary anchor release mechanism of the wellbore tool of the present invention is an alternate method and apparatus for unsetting the anchor apparatus without utilizing the primary anchor release mechanism and shattering the frangible member. In the following paragraph with reference to FIG. 8a, the structure of the secondary anchor release mechanism will be discussed.

With regard to the secondary anchor release mechanism of FIG. 8a, a firing head 72 is adapted to initiate a detonation wave in a detonating cord 80. An anchor top sub 44 is threadedly connected to a ratchet ring retainer 46 which is, in turn, threadedly connected to an outer sleeve 48. An upper gauge ring 50 encloses the ratchet ring retainer 46. A pull mandrel 52 is enclosed by the ratchet ring retainer 46 and is physically connected thereto by a shear screw 54. A release sleeve 56 is enclosed by the pull mandrel 52 and is physically connected thereto by another shear screw 58. A top end of the release sleeve 56 includes a fishing profile 56*a* which is adapted to interconnect with a shifting tool which is lowered into the large opening 30 of the perforating gun 20 in FIG. 3. When the shifting tool or stinger tool physically connects with the fishing profile 56*a*, and is pushed down or pulled upwardly, the anchor 42 of FIG. 8*c* will be unset and will release from the wellbore casing 26. A top end 52*a* of the pull mandrel 52 is enclosed by a ratchet ring 60. Mating teeth associated with the inner side of the ratchet ring 60, at 60*a*, is connected to mating teeth associated with the top end 52*a* of the pull mandrel 52. In addition, the connection means 40 of FIG. 8*a* is threadedly connected to the top end 52*a* of the pull mandrel 52. As a result, in response to a push downwardly by setting tool 38*a* on the anchor top sub 44 while maintaining fixed the position of the connection means 40, the mating teeth associated with the moving inner side 60*a* of the ratchet ring 60 will move downwardly, over and past the stationary mating teeth associated with the top end 52*a* of the pull mandrel 52. When the downward push on the top sub 44 relative to the stationary top end 52*a* of the pull mandrel 52 ends, the mating teeth associated with the inner side 60*a* of the ratchet ring 60 will absolutely prevent the top sub 44 from moving back upwardly in FIG. 8*a*. As noted earlier, the ratchet ring retainer 46 is threadedly connected to the outer sleeve 48, and the pull mandrel 52 is enclosed by the ratchet ring retainer 46 and the outer sleeve 48. The pull mandrel 52 is also threadedly connected to an outer piston 62 such that the outer piston 62 is also enclosed by the outer sleeve 48. An inner piston 64 is sealingly enclosed by and is in physical contact with the outer piston 62. A piston air chamber 66 is disposed between the inner piston and the outer piston. Since the outer piston 62 is adapted to move with respect to the inner piston 64, the piston air chamber 66 is adapted to close and get smaller in response to the relative movement between the outer and inner pistons. One end of the inner piston 64 is in abutment with one end of the pull mandrel 52. The other end of the inner piston 64 is threadedly connected to a spacer 70. A release mandrel 68 is enclosed by the inner piston 64 and the spacer 70. In fact, a lower end of the release mandrel 68 is in abutment with a lower end of the inner piston, and an upper end 68*a* of the release mandrel 68 is disposed in threaded contact with an inner surface of a lower end of the pull mandrel, at 68*a*1. The upper end 68*a* of the release mandrel 68 is a "collet finger" 68*a* (hereinafter termed "a first collet finger 68*a*") since the upper end 68*a* functions like a collet finger, as will be described in more detail later in this specification. As noted earlier, a top end of the release sleeve 56 includes the shifting profile 56*a*; however, the bottom end of the release sleeve 56 includes an upset 56*b*. When the release sleeve 56 is disposed in the position shown in FIG. 8*a*, the upset 56*b* of the release sleeve 56 will hold the first collet finger 68*a* of the release mandrel 68 firmly in place; and, as a result, the threads disposed on an outer peripheral surface of the first collet finger 68*a* (see numeral 68*a*1) will be held firmly into contact with the threads disposed on the inner peripheral surface of the one end 52*b* of the pull mandrel 52. However, an outer surface of the upset 56*b* can easily slide across the inner surface of the first collet finger 68*a* (see numeral 56*b*1) in response to a push or a pull being exerted on the shifting profile 56*a* of the release sleeve 56. When the upset 56*b* moves past the first collet finger 68*a* in response to the push or pull on the shifting profile 56*a*, the first collet finger 68*a* is free to pull away from the one end 52*b* of the pull mandrel 52. When this happens, the threads disposed on an outer peripheral surface of the first collet finger 68*a* (see numeral 68*a*1) will no longer be held firmly into contact with the threads disposed on the inner peripheral surface of the one end 52*b* of the pull mandrel 52. Fluid pressure forces the air chamber of the inner and outer piston to close. As a result, the anchor 42 can be unset which will release the grip the anchor 42 has on the wellbore casing 26. This function will be described in more detail later in this specification.

In FIG. 8*b*, the spacer 70 is shown enclosed by the outer sleeve 48. The firing head 72 is enclosed by the spacer 70. The outer sleeve 48 is threadedly connected to an intermediate housing 74 and the spacer 70 is threadedly connected to a support sleeve 76. The firing head 72 in the preferred embodiment is a "hydraulic delay type" firing head. The firing head 72 is connected to a firing head adaptor 78, the firing head adaptor 78 physically enclosing a detonating cord 80. The detonating cord is ultimately connected to the shaped charges of a perforating gun.

In FIG. 8*c*, the wellbore tool of the present invention includes a primary anchor release mechanism for releasing the anchor apparatus from the wellbore casing by shattering a frangible member. In the following paragraph with reference to FIG. 8*c*, the structure of the primary anchor release mechanism will be discussed.

Figure 8D:
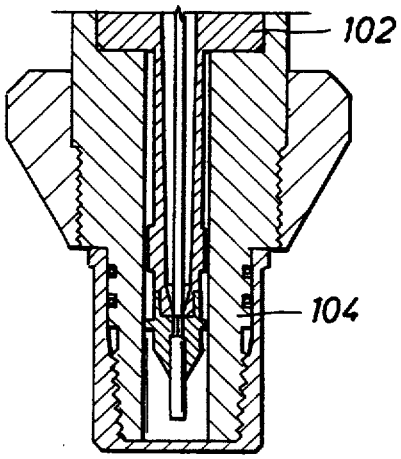

With regard to the primary anchor release mechanism, the intermediate housing 74 is threadedly connected to an upper slip housing 82 and a second gauge ring 84 firmly encloses the intermediate housing 74. The support sleeve 76 is threadedly connected, and locked with a set screw 86, to one end of a slip release 88. The other end of the slip release 88 includes a second collet finger 88*a*. The upper slip housing 82 is disposed in abutment, at 82*a*, against one end of the slip 42*a* of the anchor 42. The other end of the slip 42*a* has a beveled "dovetail" end 42*b* which is intermeshingly adapted to mate with a beveled "dovetail" end 90*a* of a lower slip housing 90. When the upper slip housing 82 moves downwardly in FIG. 8*c*, due to the abutted end of slip 42*a* and the respective beveled ends 42*b* and 90*a*, the slip 42*a* of anchor 42 in FIG. 8*c* expands radially outwardly until the slip 42*a* firmly grips the wellbore casing 26 of FIGS. 2 and 7. The lower slip housing 90 has an inner wall surface 90*c*; and an upset 90*b* extends radially inwardly from the inner wall surface 90*c* of the lower slip housing in FIG. 8*c*. The upset 90*b* is threaded. The second collet finger 88*a* includes an outer peripheral surface 88*a*1 which is also threaded. In FIG. 8*c*, the end of the second collet finger 88*a* is disposed in abutment with the upset 90*b* of the lower slip housing 90. Recall that the upset 90*b* is threaded and the outer peripheral surface 88*a*1 of the second collet finger 88*a* is also threaded. When the end of the second collet finger 88*a* is disposed in abutment with the upset 90*b* of the inner wall surface 90*c* of the lower slip housing 90, the threads of the second collet finger 88*a* will also be in abutment with the threads of the upset 90*b*, at 88*a*1. As a result of the aforementioned threads in abutment against one another, the lower slip housing 90 cannot move either upwardly or downwardly. The firing head adaptor 78 is sealingly but not threadedly connected to a release piston 92. The release piston 92 includes an upset 92*a*. In FIG. 8*c*, a release pin 94 is disposed between the upset 92*a* of the release piston 92 and the second collet finger 88*a* of the slip release 88. As long as the release pin 94 is disposed between the upset 92*a* and the second collet finger 88*a*, the threads of the second collet finger 88*a* (see numeral 88*a*1 in FIG. 8*c*) will remain in abutment with the threads of the upset 90*b*. However, when the upset 92*a* moves away from the release pin 94, the release pin 94 can no longer hold the threads of the second collet finger 88*a* into abutment with the threads of the upset 90*b*. When this happens, the lower slip housing 90 can move downwardly in FIG. 8*c* thereby releasing the slip 42*a* of the anchor 42. More on this function later in this specification. One end 76*a* of the support sleeve 76 is threadedly disposed in abutment with a break plug housing 96, the break plug housing 96 being sealingly disposed, with o-rings, between the lower slip housing 90 and the release piston 92. The interface between the break plug housing 96 and the lower slip housing 90 forms an air chamber 98. Although the slip release 88 and the break plug housing 96 remain fixed, the lower slip housing 90 is movable downwardly. As a result, the volume of the air chamber 98 will decrease in response to the movement of the lower slip housing 90. In addition, the release piston 92 could be movable downward to close air chamber 92*b*. However, a frangible member 100 also known as a break plug 100 firmly holds the release piston 92 into the position shown in FIG. 8*c*. The frangible member 100 is disposed between the release piston 92 and a break plug adapter 102. Since the break plug adapter 102 is threadedly fixed in position, as long as the frangible member 100 is intact, the frangible member 100 will prevent the release piston 92 from moving downwardly. The frangible member 100 (or break plug 100) includes a plurality of individual frangible members, as shown in FIG. 8*c*, and is comprised of a cast iron material. Cast iron material includes the following types of iron: white iron, gray iron, ductile iron, and malleable iron. Therefore, since the frangible member 100 is comprised of cast iron, the frangible member 100 could be comprised of either one of the following materials: white iron, gray iron, ductile iron, or malleable Iron. In FIGS. 3*c* and 8*d*, the break plug adaptor 102 is threadedly disposed in the break plug housing 96, the gun adaptor 104 being threadedly connected to the break plug housing 96 for connection to a perforating gun which includes a plurality of shaped charges. The detonating cord 80 of FIG. 8*c* is connected to the shaped charges of the perforating gun and is disposed within an interior space of the following parts: the release piston 92, the frangible member/break plug 100, the break plug adaptor 102, and the gun adaptor 104. When a detonation wave propagates through the interior of the frangible member 100, since the frangible member is made of a cast iron material, the frangible member will shatter into a multitude of pieces. The shattering of the frangible member 100 into the multitude of pieces will allow the anchor 42 to unset and allow the anchor to release its grip from the wellbore casing 26. This function will be described in more detail later in this specification. Since, in FIG. 8*c*, the detonating cord 80 is not directly connected to the perforating gun, an end of the detonating cord 80 is shown connected to a booster.

Referring to FIGS. 9*a*–9*d*, a more detailed and alternative construction of the anchor apparatus of the wellbore tool of FIG. 8*c* is illustrated.

Figure 9B:
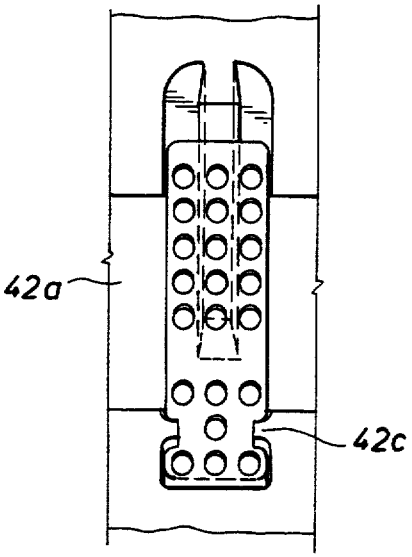
FIGS. 9*a*–9*d* illustrate a more detailed and alternative construction of the anchor apparatus of the wellbore tool of FIG. 8*a*–8*d* which grips the wellbore casing.

In FIG. 9*b*, on the right-hand side of FIG. 9*b*, the anchor slip 42*a* is shown disposed between the upper slip housing 82 and the lower slip housing 90, and the beveled surfaces 42*b*/90*a* of the anchor slip 42*a* and lower slip housing 90 are pointed downwardly on the right hand side of FIG. 9*b* similar to the beveled surfaces shown in FIG. 8*c*. However, on the left-hand side of FIG. 9*b*, the beveled surfaces 42*b*/82*b* reflect an interface between the beveled surface 42*b* of the anchor slip 42*a* and the beveled surface 82*b* of the upper slip housing 82, not the lower slip housing 90. On the left hand side of FIG. 9*b*, the anchor slip 42*a* is pointed upwardly, whereas, on the right hand side of FIG. 9*b*, the anchor slip 42*a* is pointed downwardly. Otherwise, the anchor apparatus of the wellbore tool of FIGS. 8*a*–8*d* is identical to the anchor apparatus of the wellbore tool of FIG. 9*b*.

Figure 9A:
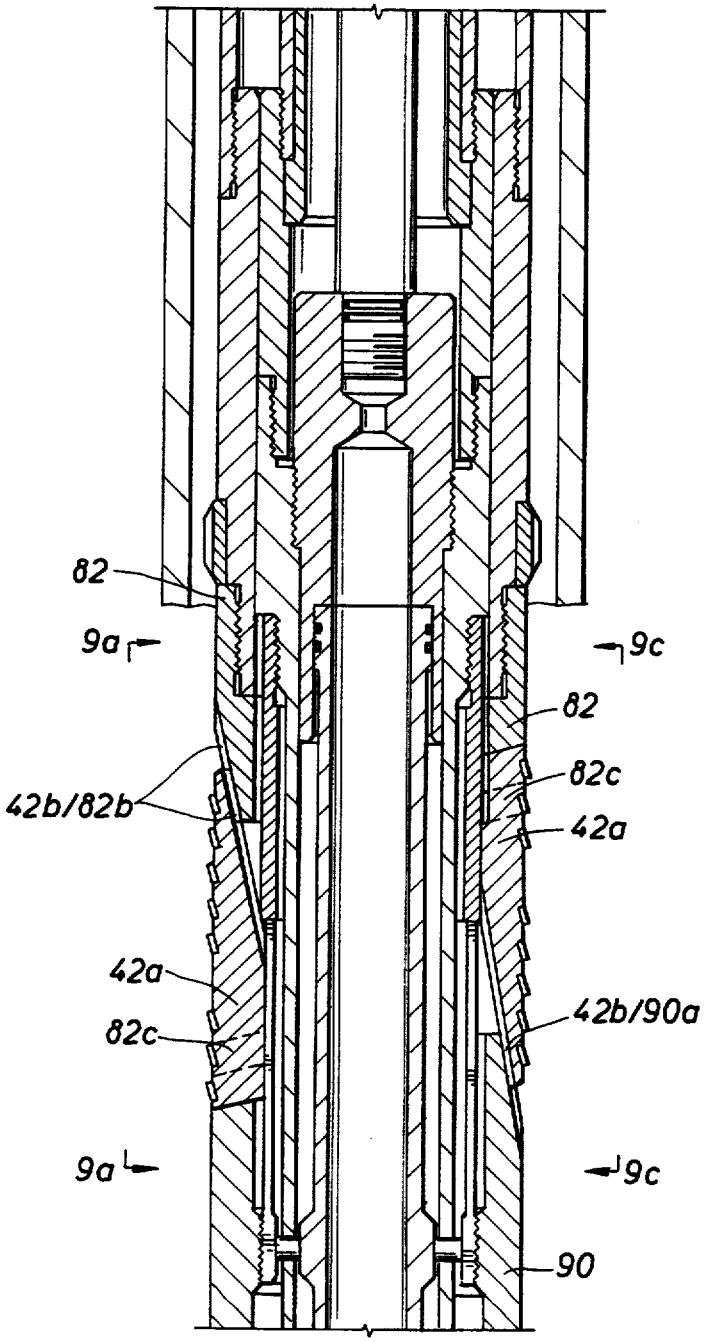
Figure 9D:
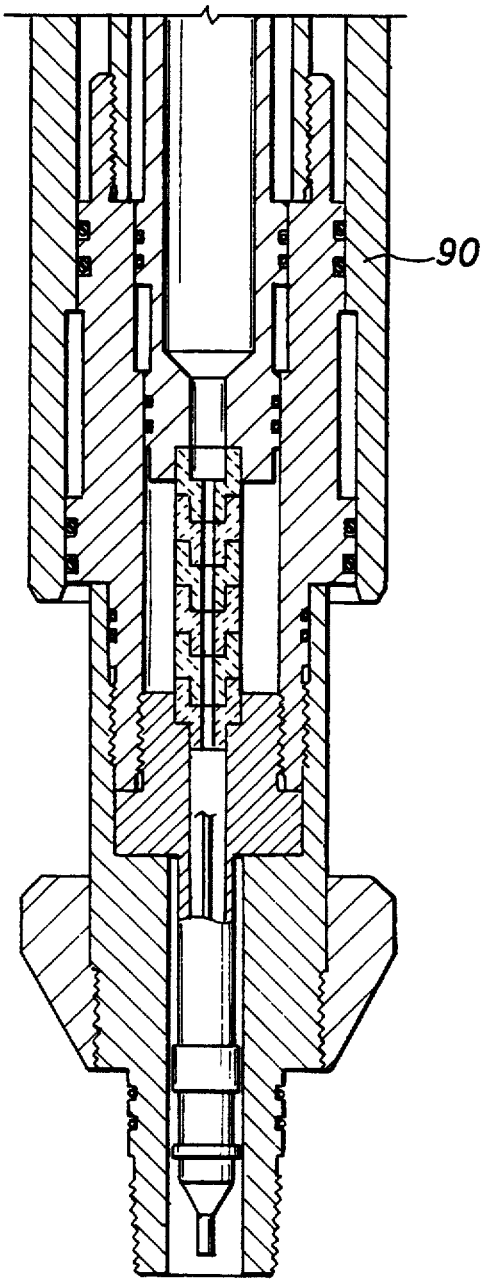
Figure 9C:
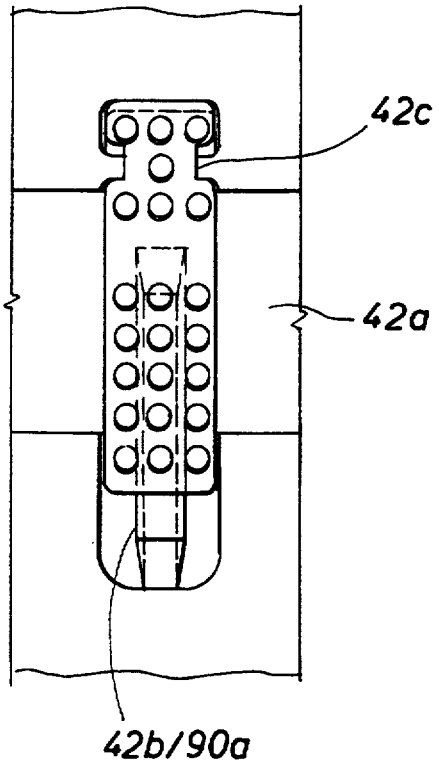

In FIGS. 9*a* and 9*c*, FIG. 9*a* illustrates the anchor slip 42*a* on the left hand side of FIG. 9*b*, whereas FIG. 9*c* illustrates the anchor slip 42*a* on the right hand side of FIG. 9*b*.

In FIG. 9*c*, the anchor slip 42*a* includes a t-slot 42*c*. In FIG. 9*d*, the upper slip housing 82 includes a member 82*c* which is designed to fit snugly within the t-slot 42*c* of the anchor slip 42*a* of FIG. 9*c*. The member 82*c*, when disposed within the t-slot 42*c*, will hold the anchor slip 42*a* in a retracted position when the anchor is unset and the slip 42*a* is disposed in the retracted position. In FIG. 9*b*, the slip 42*a* is shown in the retracted position and the anchor 42 is unset.

A functional description of the wellbore tool of the present invention, including the anchor apparatus of the present invention having slips which expand to grip a casing, the primary anchor release mechanism and the secondary anchor release mechanism for unsetting the anchor 42, will be set forth in the following paragraphs with reference to FIGS. 10*a* to 15*c* of the drawings.

Figure 11A:
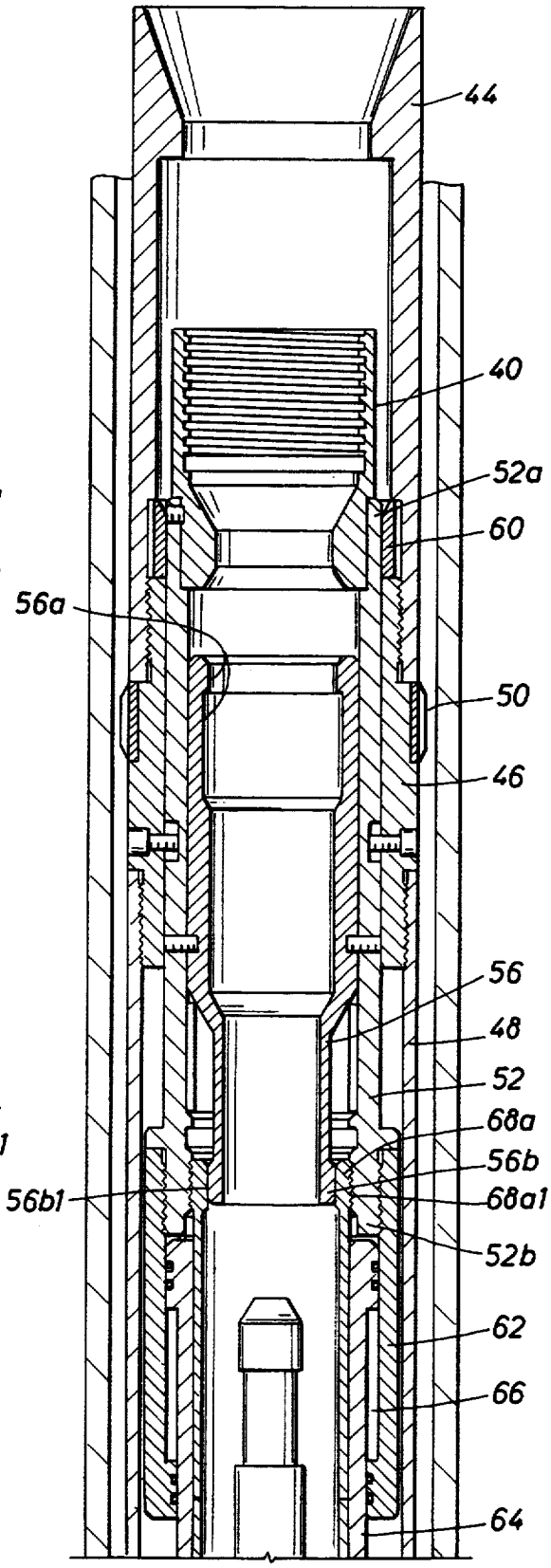
FIGS. 11*a*–11*c* illustrates a schematic of the wellbore tool of the present invention when the wellbore tool is run into the wellbore before the anchor apparatus is set and anchored to the wellbore casing.
Figure 11B:
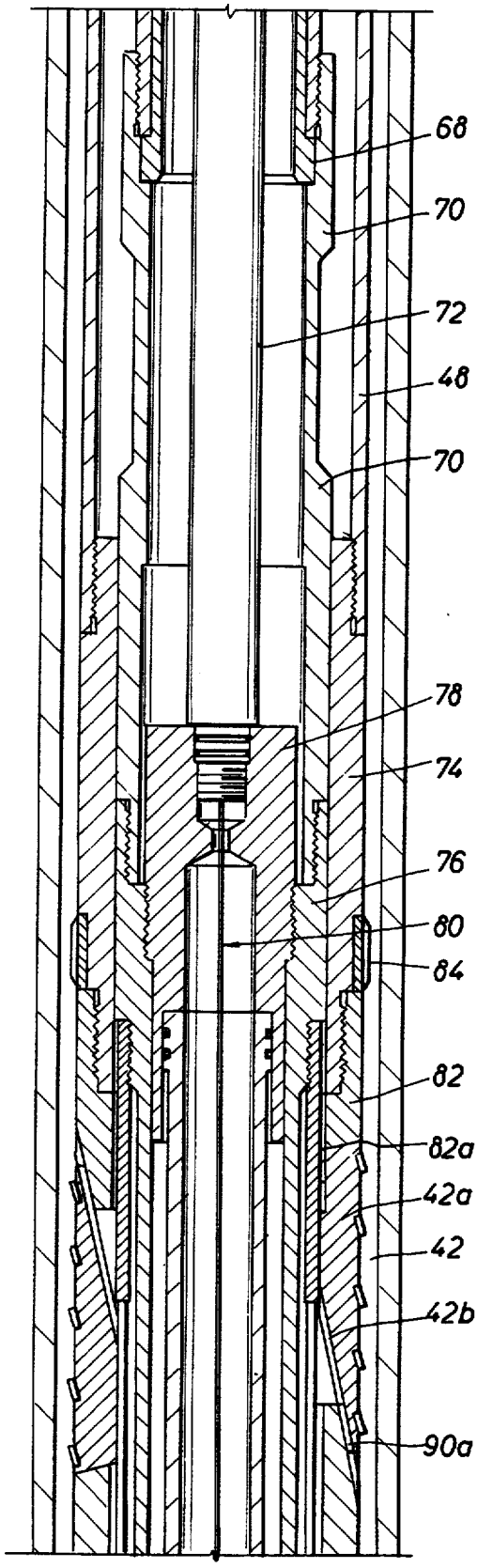
Figure 11C:
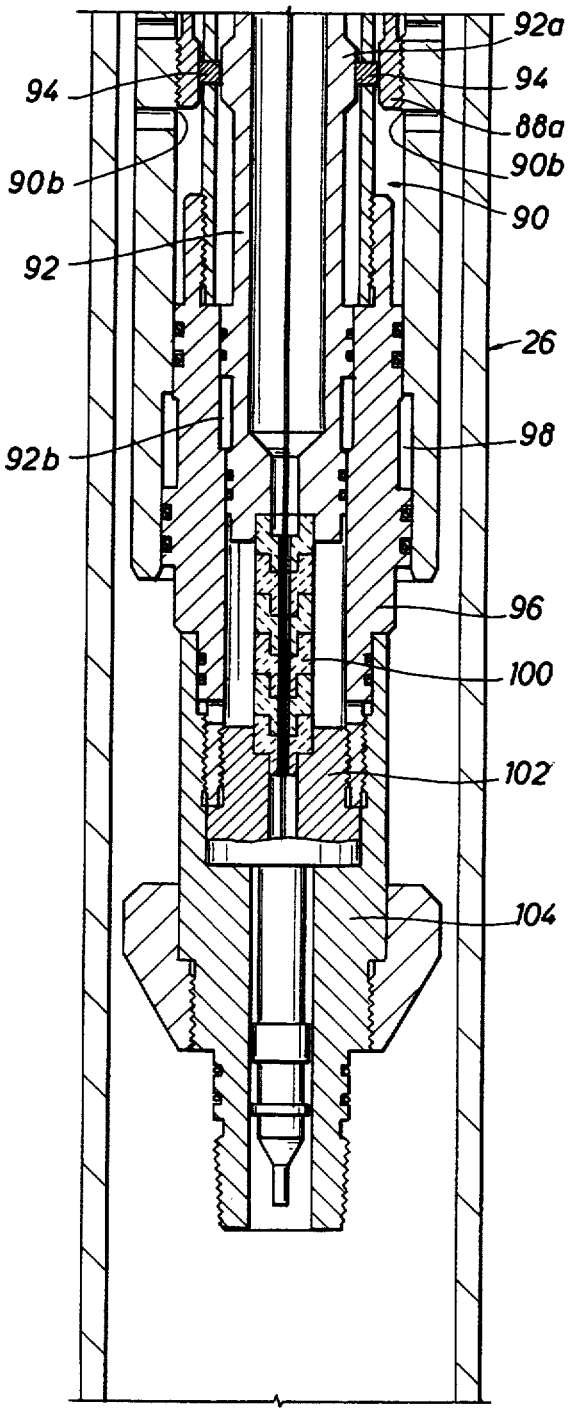

Referring to FIGS. 11*a* through 11*b*, a schematic of the wellbore tool of the present invention is illustrated in a condition where the tool has been run into the wellbore but the anchor has not been set and anchored to the wellbore casing. In FIGS. 11*a*–11*c*, the wellbore tool of the present invention has already been run into the wellbore and the anchor setting apparatus 38 of FIG. 7 (although not shown in FIGS. 11*a*–11*c*) is attached to the setting tool adaptor (connection means) 40 of the wellbore tool in the manner illustrated in FIG. 7 of the drawings. However, the anchor 42 has not yet been set. Therefore, the anchor setting apparatus 38 did not yet set the anchor 42.

In FIG. 11*a*, it is important to note that the upset 56*b* of the release sleeve 56 continues to hold the first collet finger 68*a* of the release mandrel 68 firmly in place; and, as a result, the threads disposed on the outer peripheral surface of the first collet finger 68*a*, at 68*a*1, are being held firmly into contact with the threads disposed on the inner peripheral surface of the one end 52*b* of the pull mandrel 52. Consequently, the alternate apparatus of FIG. 8*a* has not yet released the anchor from the wellbore casing (recall that the alternate apparatus of FIG. 8*a* releases the anchor 42 without shattering the frangible member 100).

In FIG. 11*b*, it is important to note that the upset 92*a* of the release piston 92 forces the release pin 94 into abutment with the second collet finger 88*a*. As a result, the second collet finger 88a is forced into abutment with the upset 90b. Consequently, the threads of the second collet finger 88a, at 88a1, remain in abutment with the threads of the upset 90b. In addition, the slips 42a of the anchor 42 are not yet firmly gripping the wellbore casing 26, and the frangible member 100 is still intact. Therefore, the anchor release mechanism of FIG. 8c has not yet released the anchor 42 (recall that the anchor release mechanism of FIG. 8c releases the anchor 42 by shattering the frangible member 100).

Referring to FIGS. 7 and 10a–10c, a schematic of the wellbore tool of the present invention is illustrated in a condition where the anchor 42 has been set and anchored to the wellbore casing 26. When the anchor setting apparatus 38 sets the anchor 42, it pushes the anchor top sub 44 downwardly in FIG. 10a while maintaining the connection means 40 in FIG. 10a fixed in position. This relative movement of the anchor top sub 44 relative to the connection means 40 will set the anchor 42 by expanding the slips 42a of anchor 42 radially outwardly.

Figure 10A:
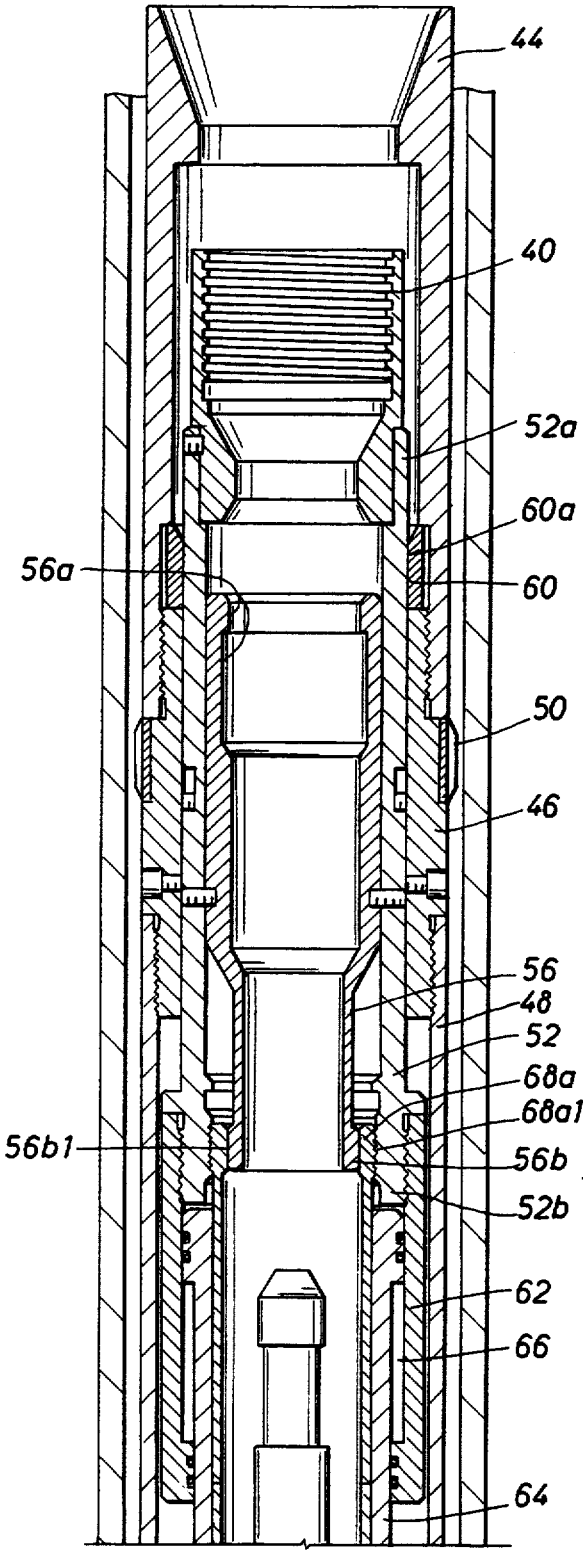
FIGS. 10*a*–10*c* illustrates a schematic of the wellbore tool of the present invention when the anchor apparatus is set and anchored to the wellbore casing.

In FIG. 10a, the anchor setting apparatus 38 of FIG. 7 pushed down on the anchor top sub 44 while maintaining the position of the connection means 40. During the downward movement of top sub 44 relative to connection means 40, the mating teeth associated with the inner side of the ratchet ring 60, at 60a, will move over and past the mating teeth associated with the outer side of the top end 52a of the pull mandrel 52. When the relative movement of the top sub 44 and ratchet ring 60 with respect to the pull mandrel 52 ends, the mating teeth of the top end 52a of pull mandrel 52 will absolutely prevent the mating teeth of the ratchet ring 60 from moving back upwardly in FIG. 10a. As a result of the respective mating teeth 60a being in abutment against each other, when the anchor 42 is set, the anchor 42 will remain set, gripping the wellbore casing 26, until either the frangible member 100 is shattered or the shifting profile 56a of the release sleeve 56 is moved either upwardly or downwardly so as to release the first collet finger 68a from its position in abutment, at 68a1, against the pull mandrel 52.

Figure 10B:
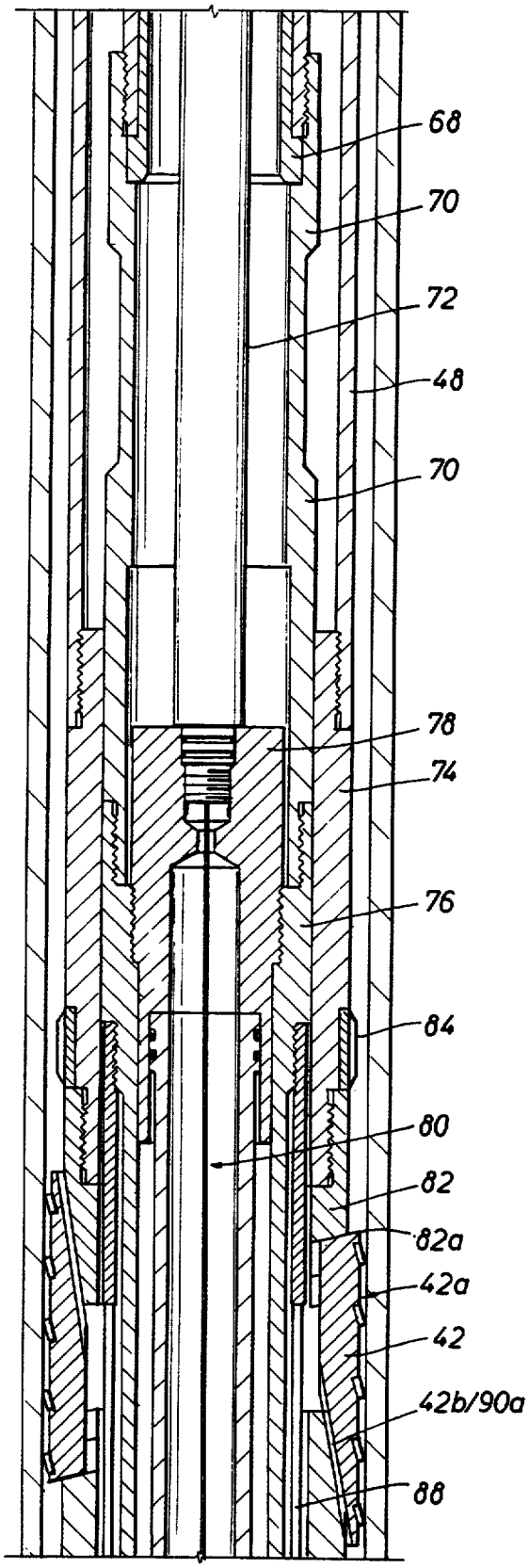
Figure 10C:
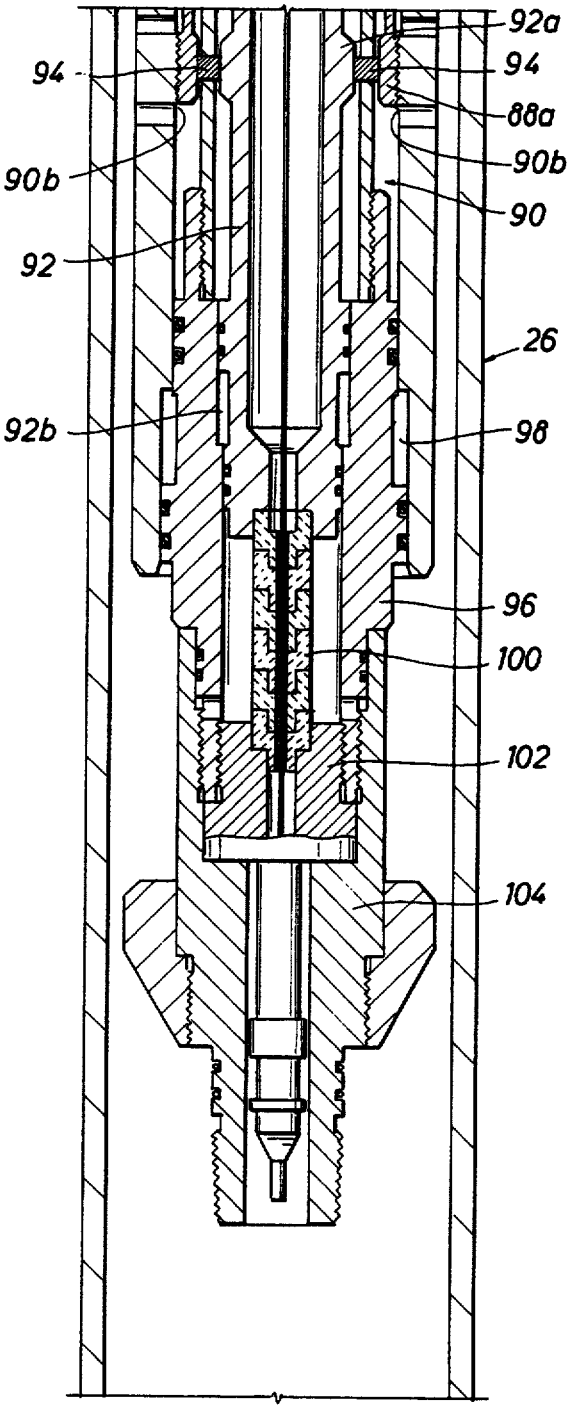

In FIGS. 10a–10c, continuing with the description of the functional operation of the present invention, during the downward movement of top sub 44 in FIG. 10a, the ratchet ring retainer 46 will move downwardly, the outer sleeve 48 will move downwardly, the intermediate housing 74 of FIG. 11b will move downwardly, and the upper slip housing 82 will move downwardly into its position of abutment at 82a against the slip 42a of the anchor 42. The lower slip housing 90 cannot move in either direction because the second collet finger 88a is firmly held against the upset 90b of the lower slip housing 90. As a result, since the upper slip housing 82 is moving downwardly, but the lower slip housing 90 remains fixed in position, the beveled "dovetail" end 42b of the slip 42 moves with respect to the intermeshing beveled "dovetail" end 90a of the lower slip housing 90. Consequently, the slip 42a of the anchor 42 must expand radially outwardly and firmly grip the wellbore casing 26.

In FIG. 7, even though the anchor 42 is set and the anchor grips the wellbore casing 26, the anchor setting apparatus 38 will continue to push the anchor top sub 44 downwardly relative to the stationary connection means 40 until the tension stud severs apart, at the recess, and allows the collapsible collet fingers 38a2a to collapse and release from the connection means 40 of FIG. 10a.

When the adaptor portion 38a2c is released from the connection means 40, the anchor setting apparatus 22 of FIGS. 2 and 3 can be raised upwardly to the wellbore surface, leaving behind a large opening 30 on the top of the perforating gun 20 in FIG. 3. A separate "shifting tool" may be lowered into the large opening 30, attached to the shifting profile 56a in FIG. 10a, and manipulated in either the upward or downward direction so as to slide the upset 56b of FIG. 10a along the inner surface of the first collet finger 68a, at 56b1, thereby unseating the first collet finger 68a from its abutment position, at 68a1, against the pull mandrel 52. This structure and function is the "secondary anchor release mechanism", since it represents an alternate method and apparatus for unsetting and releasing the anchor 42 without shattering the frangible member 100, a function which will be described in more detail later in this specification.

Figure 13A:
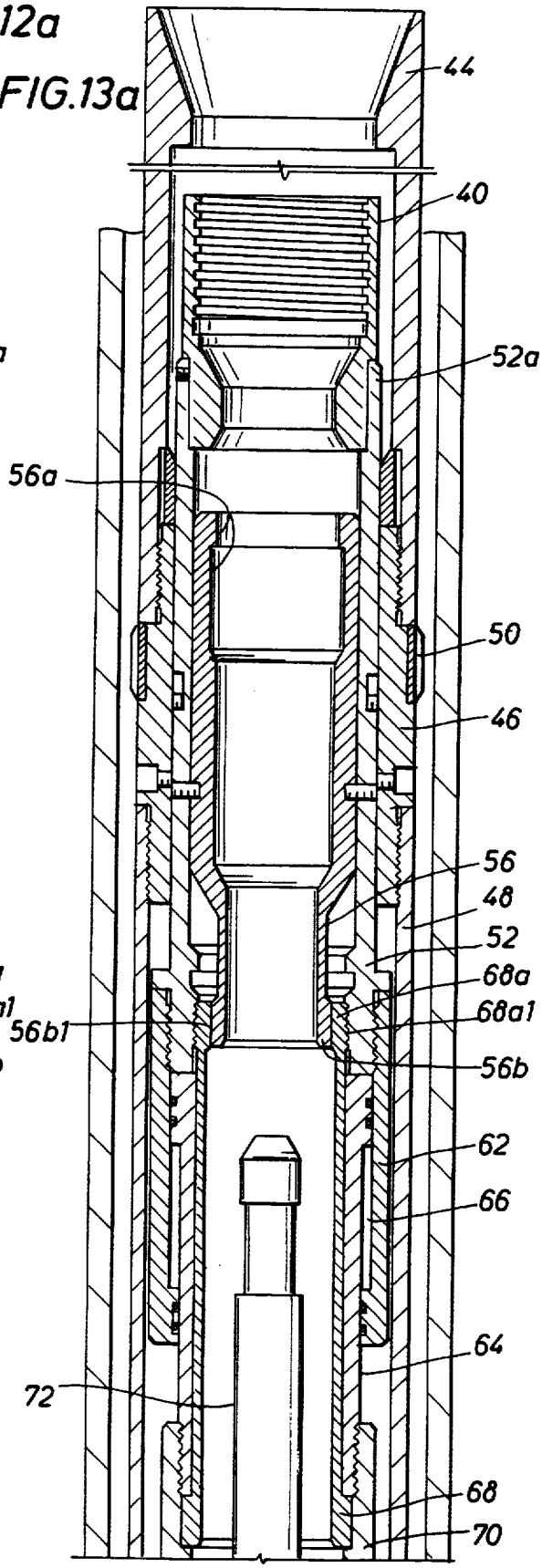
FIGS. 13*a*–13*c* illustrates a schematic of the wellbore tool of the present invention when the frangible member has been shattered, but the anchor apparatus has not been unset, and the anchor has not been released from the wellbore casing.
Figure 13B:
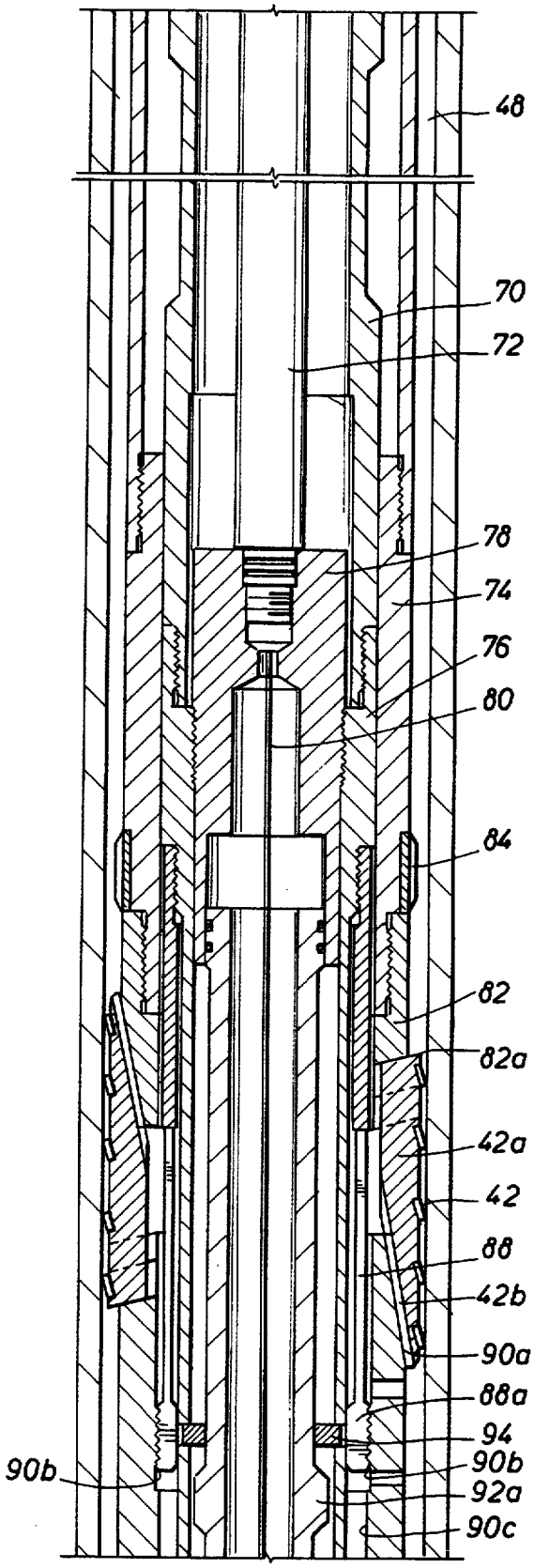
Figure 13C:
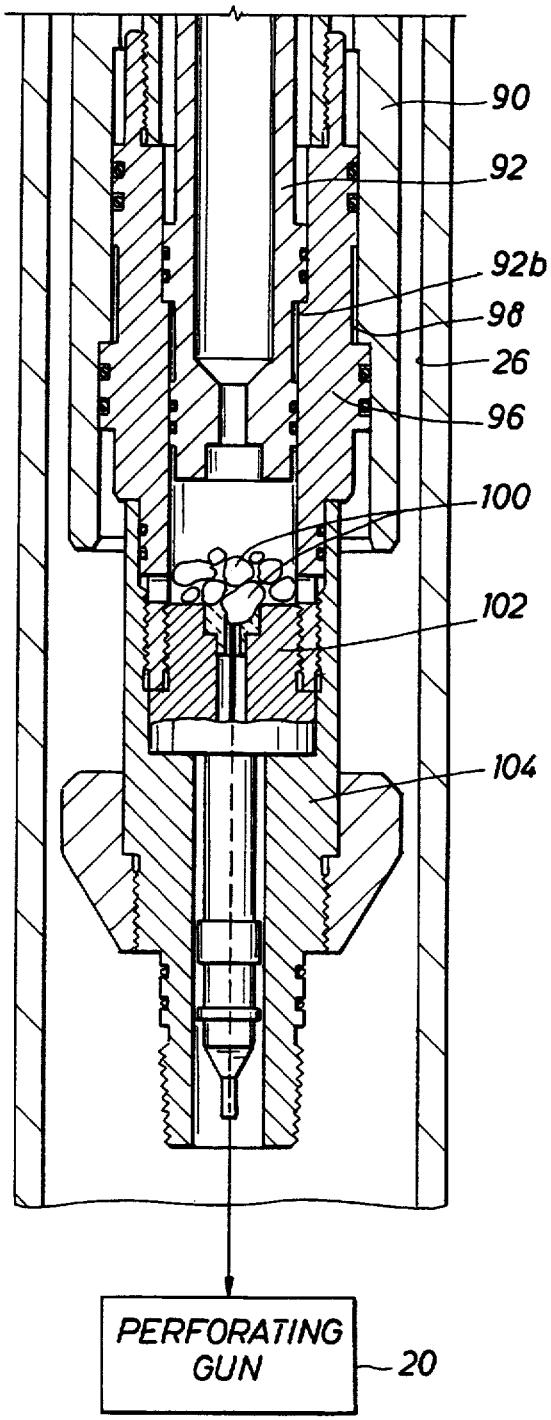

Referring to FIGS. 13a–13c, a schematic of the wellbore tool of the present invention is illustrated when disposed in a condition where the frangible member has been shattered, but the anchor has not been unset, and the anchor has not been released from the wellbore casing.

A perforating gun 20 is attached to the gun adaptor 104 in FIG. 13c. The functional description presented above with reference to FIGS. 11a–11c and 10a–10c described how the anchor 42 was set and how the tension stud severed apart. As a result, at this point in the functional description, the perforating gun 20, attached to the gun adaptor 104 of FIG. 13c, is now standing alone, anchored by anchor 42 to the wellbore casing 26, in the manner illustrated in FIGS. 2–3 of the drawings. The anchor setting apparatus 38 of FIG. 7 has already been raised to a surface of the wellbore in the same manner illustrated in FIGS. 2 and 3 in connection with the anchor setting apparatus 22.

In FIG. 13a, firing head 72, being a hydraulic delay type firing head, initiates the propagation of a detonation wave in the detonating cord 80 of FIG. 13b.

In FIGS. 13b and 13c, the anchor 42 is still set; therefore, the anchor slip 42a is firmly gripping the wellbore casing 26. However, the detonation wave in detonating cord 80 propagates through the interior of the frangible member 100. As a result, since the frangible member is made of a cast iron material, the frangible member 100 shatters into a multitude of pieces, as illustrated by the individual pieces of material representing the frangible member 100 in FIG. 13b. When the frangible member 100 shatters, since there is no longer any support for the release piston 92, the release piston 92 is forced to move downwardly as illustrated in FIGS. 13a–13b as a result of fluid pressure effecting a differential area against an air chamber 92b, show in FIGS. 13c. When the release piston 92 moves downwardly as illustrated in FIG. 13b, the upset 92a of the release piston 92 moves down and away from the release pin 94. Therefore, the release pin 94 no longer supports the second collet finger 88a up against the upset 90b of the inner wall surface 90c of the lower slip housing 90. As a result, the second collet finger 88a moves away from the upset 90b thereby allowing the lower slip housing 90 to move downwardly in FIG. 13b in response to fluid pressure affecting a differential area against an air chamber 98.

Figure 12A:
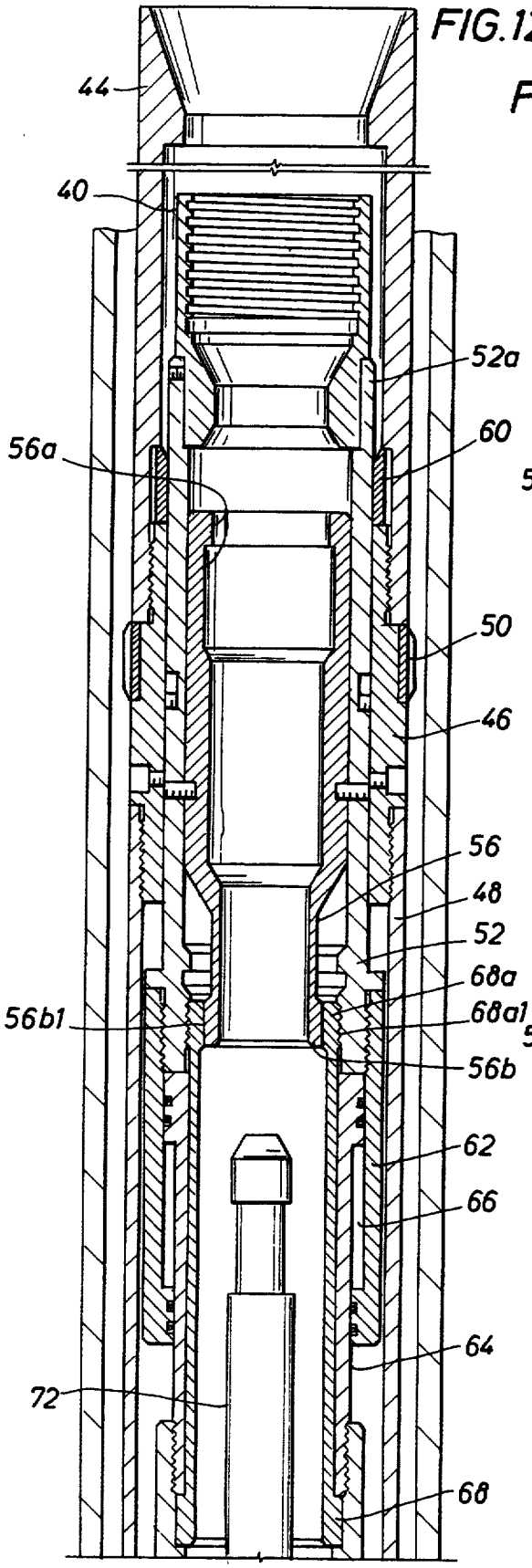
FIGS. 12*a*–12*c* illustrates a schematic of the wellbore tool of the present invention when the frangible member has been shattered, the anchor has been unset, and the anchor has been released from the wellbore casing.
Figure 12B:
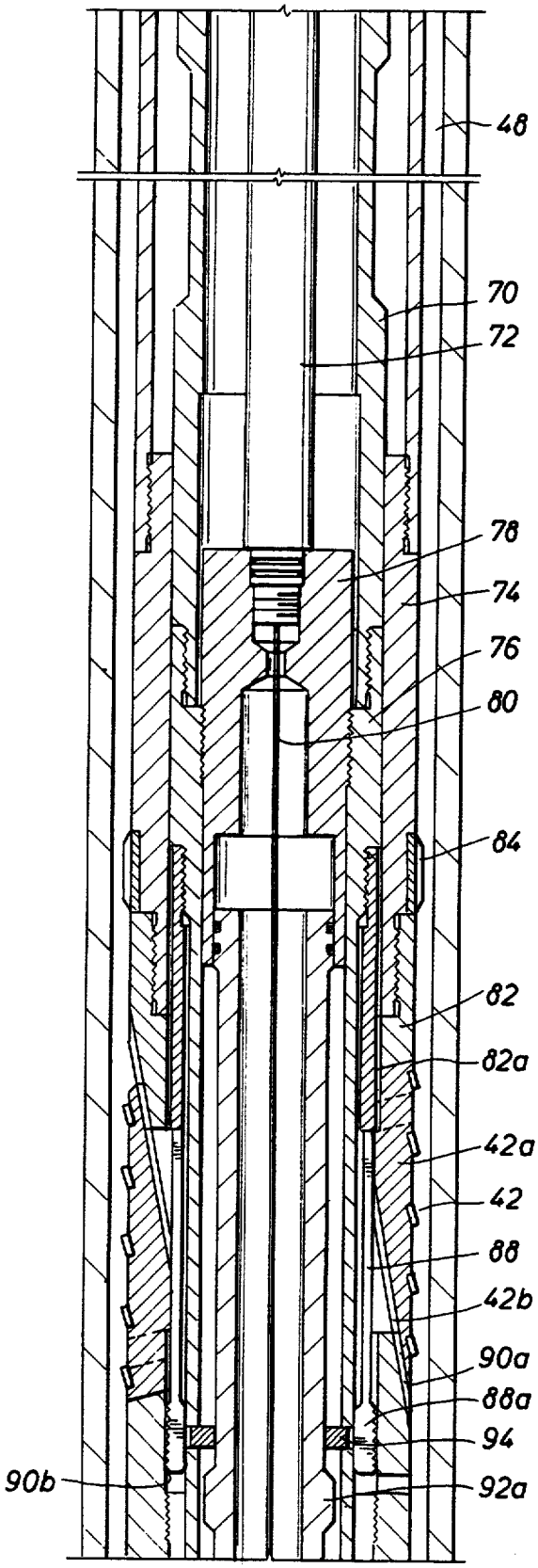
Figure 12C:
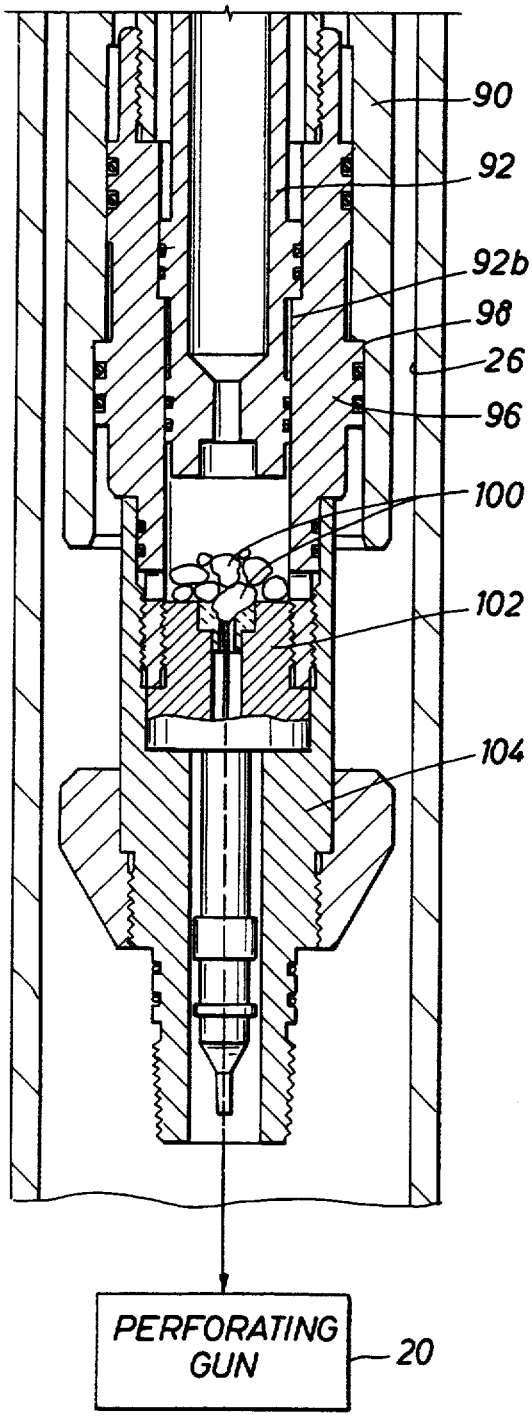

Referring to FIGS. 12a–12c, a schematic of the wellbore tool of the present invention is illustrated when disposed in a condition where the frangible member has been shattered, the anchor has been unset, and the anchor has been released from the wellbore casing.

In FIG. 12*b*, since the second collet finger 88*a* moved away from the upset 90*b* of the lower slip housing 90, the lower slip housing 90 can now move downwardly in FIG. 13*b* in response to fluid pressure against air chamber 98. In FIG. 12*b*, the lower slip housing 90 has already moved downwardly in response to the fluid pressure. As a result, the intermeshing beveled "dovetail" surface 90*a* of the lower slip housing 90 moves out from underneath the intermeshing beveled "dovetail" surface 42*b* of the slip 42*a*, and, since the upper end of slip 42*a* is held by another t-slot in upper slip housing 82, the intermeshing dovetail surface retracts the slips 42*a* radially inward of anchor 42 allowing the anchor 42 to unset and release its grip from the wellbore casing 26. The anchor and perforating guns now fall to the bottom of the wellbore.

Referring to FIGS. 14*a*–14*c* and 15*a*–15*c*, the secondary anchor release mechanism according to one aspect of the present invention and involving an alternate method and apparatus for mechanically unsetting and releasing the anchor 42 without also shattering the frangible member 100 and detonating the perforating gun 20 is illustrated.

There may be situations where the anchor 42 must be unset and its grip released from the wellbore casing 26 without also detonating the perforating gun 20 and shattering the frangible member 100. In these types of situations, there must be an alternate method and apparatus for unsetting the anchor 42 without shattering the frangible member 100. FIGS. 14*a*–14*c* and 15*a*–15*c* provide such an alternate method and apparatus.

Figure 15A:
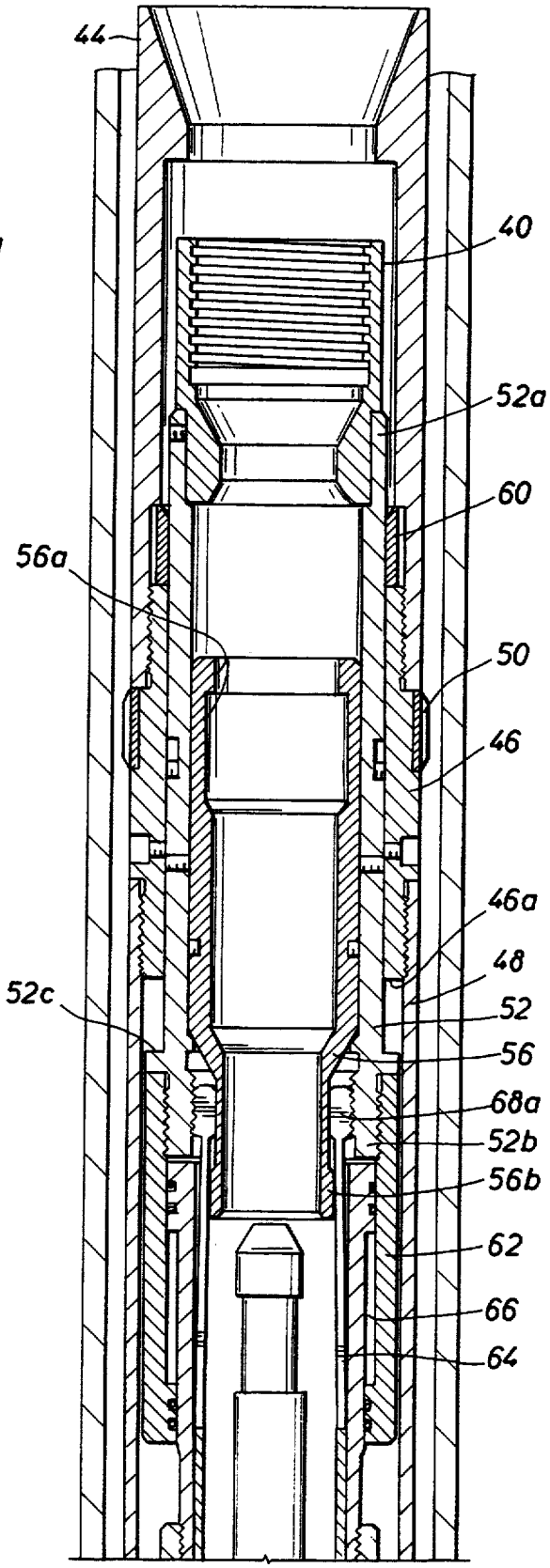

In FIG. 15*a*, the anchor 42 is still set. Lower slip housing 90 is locked in position by second collet fingers 88*a* because frangible member 100 has not been shattered. However, a separate shifting tool (not shown) is lowered into the wellbore, the shifting tool passing through the large opening 30 in FIG. 7 created when the collet fingers 38*a*2*a* of the setting adaptor 38*a*2 release from the connection means 40. The shifting tool is attached to the fishing profile 56*a* of the release sleeve 56 in FIG. 15*a*. The shifting tool is forced downwardly, forcing fishing profile 56*a* and the upset 56*b* downwardly in FIG. 15*a*. The upset 56*b* moves away from the first collet finger 68*a* thereby releasing its hold on the first collet finger 68*a*. When the first collet finger 68*a* is released, the first collet finger 68*a* can now separate from the one end 52*b* of the pull mandrel 52.

Figure 14A:
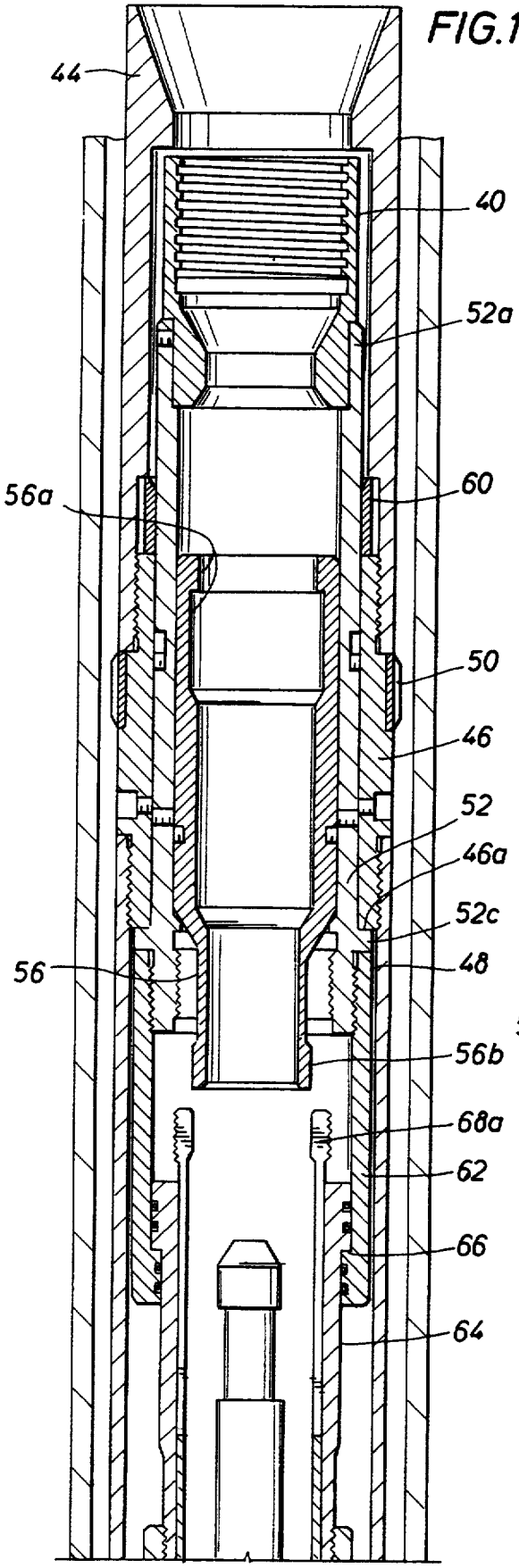
FIGS. 14*a*–14*c* and 15*a*–15*b* illustrate the secondary anchor release mechanism involving the alternate method and apparatus of the present invention for mechanically unsetting and releasing the anchor apparatus without shattering the frangible member and detonating the perforating gun, where.

In FIG. 14*a*, when the first collet finger 68*a* separates from the one end 52*b* of the pull mandrel 52, the outer piston 62 moves upward in response to fluid pressure to close the air chamber 66. The outer piston 62 is threadedly connected to pull mandrel 52. A large shoulder 52*c* on pull mandrel 52 is moved upward to abutt a downward facing shoulder 46*a* of the ratchet ring retainer 46. This moves the outer sleeve 48 upward, the intermediate housing 74 upward, and the upper slip housing 82 upward. The intermeshing dovetail beveled surfaces 42*b* and 90*a* of the slip 42*a* and the lower slip housing 90 slide across one another, the opposite end of slip 42*a* being held by a t-slot in slip housing 82, thereby allowing the slip 42*a* to retract and to move radially inward.

Figure 14B:
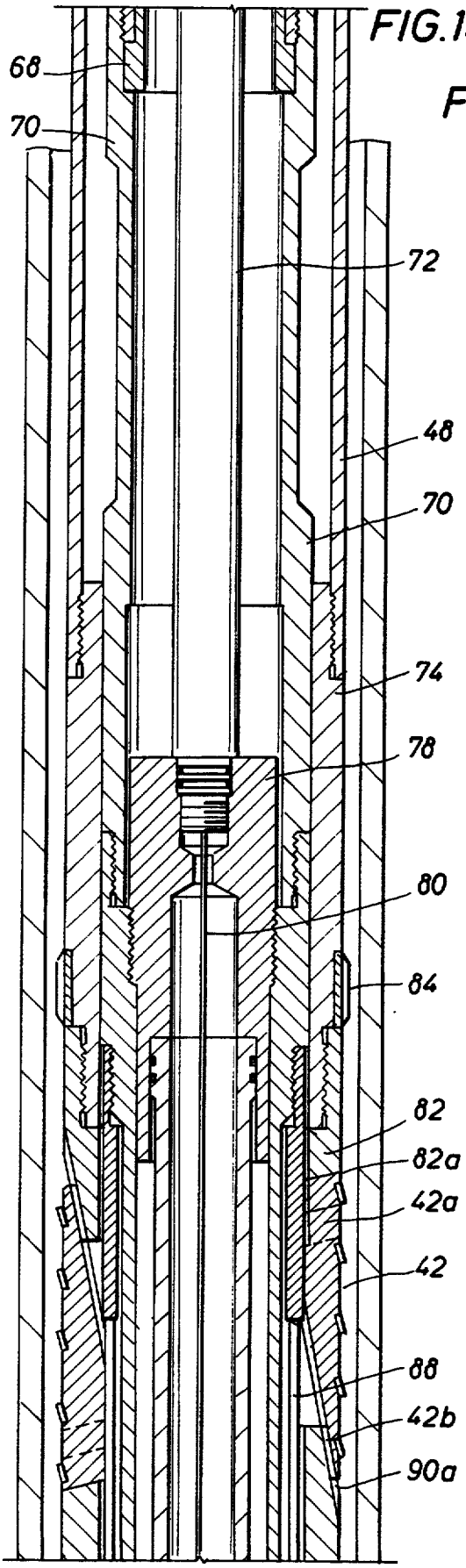
Figure 15B:
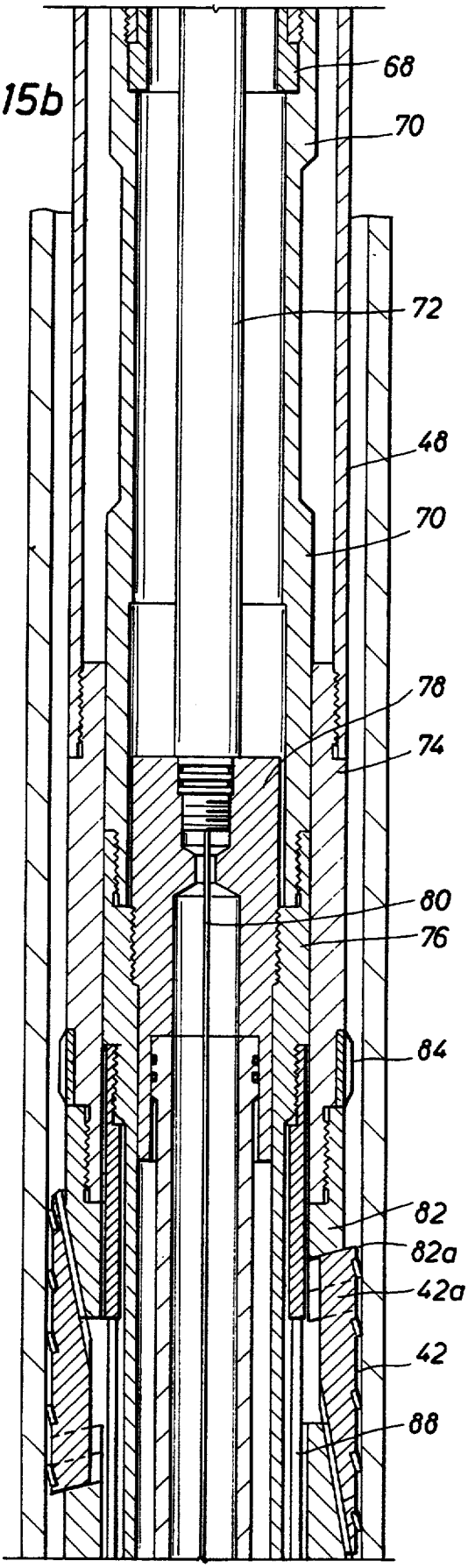
Figure 14C:
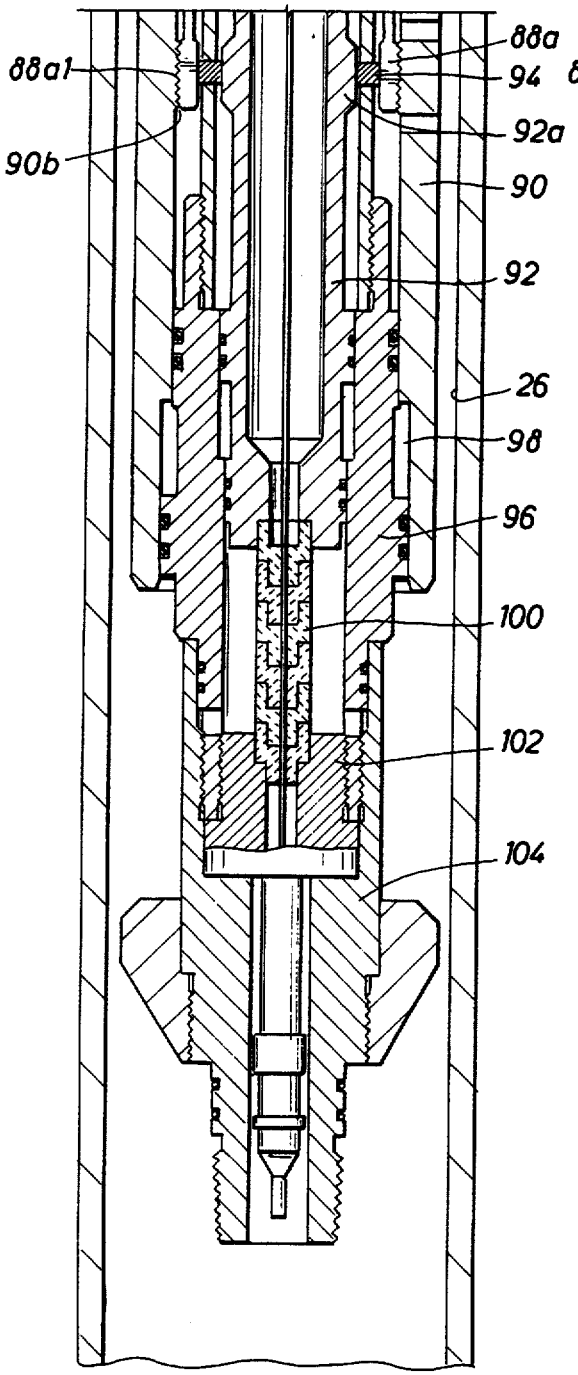
Figure 15C:
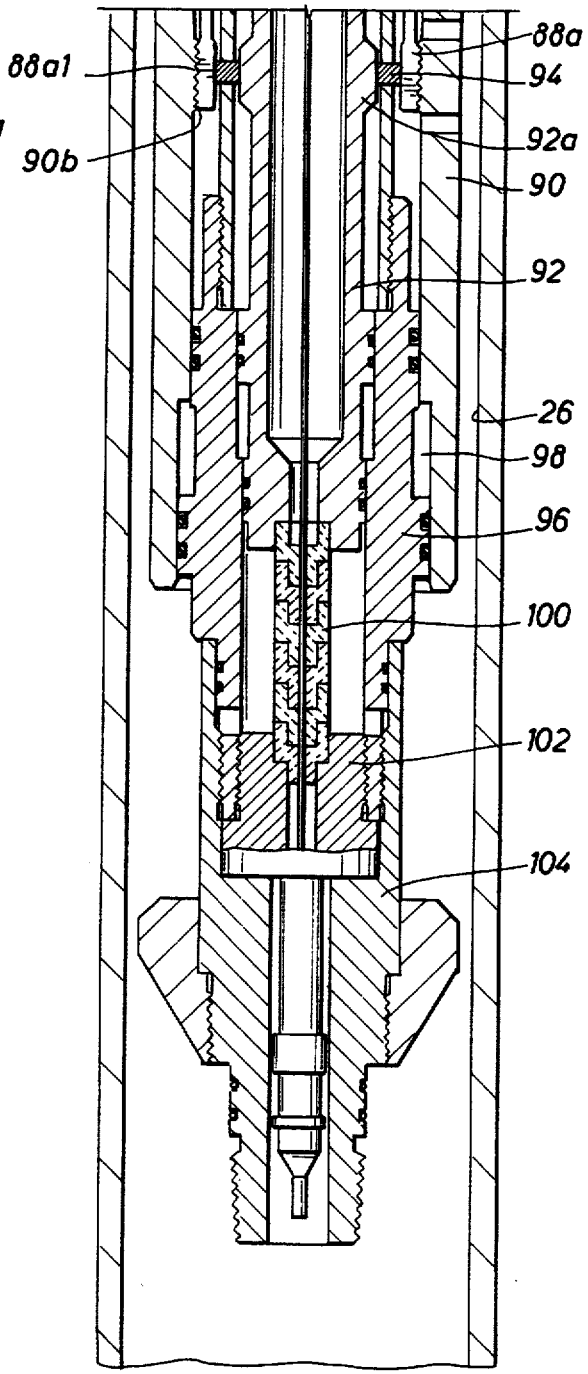

In FIG. 14*b*, the slip 42*a* of anchor 42 has retracted and the anchor 42 is now unset. Its grip has been released from the wellbore casing, and the anchor and perforating guns can fall to a bottom of the wellbore.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An anchor apparatus adapted to be disposed in a wellbore, comprising: an anchor adapted to set when a setting tool sets said anchor; and anchor release means for activating and unsetting said anchor when said anchor is set, said anchor release means including a frangible member having an interior space and being comprised of a cast iron material and a detonating cord adapted for conducting a detonation wave disposed within said interior space of said frangible member:

said anchor being set when said anchor release means has not been activated.

2. A method of setting and unsetting an anchor, comprising the steps of:

(a) setting an anchor when an anchor release mechanism is not activated; and (b) activating said anchor release mechanism to unset said anchor when said anchor is set in response to the setting step (a), the activating step including the steps of conducting a detonation wave in a detonating cord, propagating said detonation wave through an interior space of a frangible member, said frangible member being comprised of a cast iron material, and shattering the cast iron material of said frangible member in response to the detonation wave propagating through said interior space of said frangible member.

3. A wellbore tool adapted to be disposed in a wellbore including an anchor apparatus for setting and unsetting an anchor, said anchor apparatus comprising:

an upper slip housing;

a lower slip housing;

an anchor slip disposed between the upper and lower slip housings and adapted to expand radially outwardly when the upper slip housing approaches the lower slip housing, said anchor being set when said anchor slip is expanded radially outwardly;

a primary anchor release mechanism adapted to firmly hold the lower slip housing and to retain said anchor set when not activated and to release said lower slip housing and to unset said anchor when activated;

a secondary anchor release mechanism adapted to firmly hold the upper slip housing and to retain said anchor set when the primary and secondary anchor release mechanisms are not activated and to release said upper slip housing and to unset said anchor when the secondary anchor release mechanism is activated, said upper slip housing approaching said lower slip housing and expanding said anchor slip radially outwardly when the primary anchor release mechanism firmly holds the lower slip housing and the secondary anchor release mechanism firmly holds the upper slip housing, the anchor being set when the anchor slip expands radially outwardly;

top sub means connected to said upper skip housing for connecting with an outer housing of a setting tool, said top sub means being adapted to move in response to a movement of said outer housing of said setting tool; and connection means connected to the lower slip, housing for connecting with a plurality of collapsible collet fingers of said setting tool, Said connection means adapted to remain fixed in position when said collapsible collet fingers remain fixed in position, said upper slip housing approaching said lower slip housing and said anchor slip expanding radially outwardly thereby setting said anchor when said top sub means moves in response to a movement of said outer housing of said setting tool and said connection means remains fixed in position when said collapsible collet fingers remain fixed in position.

4. The wellbore tool of claim 3, further including a firing head disposed within said anchor apparatus, a detonating cord connected to said firing head adapted for propagating a detonation wave, and a perforating gun connected to said anchor apparatus and said detonating cord, said perforating gun detonating in response to said detonation wave.

5. The wellbore tool of claim 4, wherein said primary anchor release mechanism comprises:

a frangible member having an interior space, said detonating cord being disposed within said interior space of said frangible member, said frangible member shattering in response to said detonation wave propagating in said detonating cord and passing through the interior space of said frangible member, said lower slip housing being released when said frangible member shatters, said primary anchor release mechanism being activated and said anchor being unset when said lower slip housing is released.

6. The wellbore tool of claim 5, wherein said collapsible collet fingers of said setting tool collapse and disconnect from said connection thereby defining a large opening through a center of said connection means when said top sub means continues to move in response to a movement of said outer housing of said setting tool and said connection means continues to remain fixed in position in response to said collet fingers remaining fixed in position, and wherein said secondary anchor release mechanism comprises:

a release sleeve connected to said upper slip housing and including a shifting profile adapted to attach to a shifting tool, said shifting tool moving said release sleeve when said shifting tool is attached to said shifting profile, said release sleeve being disconnected from said upper slip housing when said release sleeve is moved in response to the movement of said shifting tool, said secondary anchor release mechanism being activated and said anchor being unset when said primary anchor release mechanism is not activated and said release sleeve is disconnected from said upper slip housing.

7. An anchor apparatus adapted to set and grip a wall of a wellbore, comprising:

a frangible member having an interior space and comprised of a cast iron material;

a detonating cord adapted for conducting a detonation wave disposed within the interior space of said frangible member, said frangible member being initially disposed in an intact condition, the cast iron material of said frangible member changing from the intact condition to a shattered condition when said detonation wave passes through the interior space of said frangible member;

a slip adapted for gripping said wall of said wellbore; and radial expansion means operatively associated with said slip and said frangible member for radially expanding said slip when said frangible member is in said intact condition, said slip gripping said wall of said wellbore in response to the radial expansion of said slip, the anchor apparatus being set when said slip grips the wall of said wellbore.

8. The anchor apparatus of claim 7, wherein said radial expansion means comprises:

an upper slip housing;

a lower slip housing adapted to physically approach said upper slip housing, said slip being disposed between said upper slip housing and said lower slip housing, said slip gripping said wall of said wellbore when said lower slip housing physically approaches said upper slip housing;

first means for holding said upper slip housing in a first position a secondary release of the grip of said slip from said wall of said wellbore being prevented when said first means holds said upper slip housing in said first position; and second means for holding said lower slip housing in a second position, a primary release of the grip of said slip from said wall of said wellbore being prevented when said second means holds said lower slip housing in said second position, said lower slip housing physically approaching said upper slip housing and said slip gripping said wall of said wellbore when said frangible member is in said intact condition and said first means holds said upper slip housing in said first position and said second means holds said lower slip housing in said second position.

9. The anchor apparatus of claim 8, wherein said first means comprises:

a release mandrel having a collet finger end;

a release sleeve having a shifting profile adapted to attach to a shifting tool and a collet finger end adapted to contact the collet finger end of said release mandrel, said first means holding said upper slip housing in said first position when the collet finger end of said release sleeve contacts the collet finger end of said release mandrel.

10. The anchor apparatus of claim 9, wherein said shifting profile moves in response to a movement of said shifting tool, said collet finger end of said release sleeve moving in response to the movement of said shifting profile, said collet finger end of said release sleeve not contacting the collet finger end of said release mandrel when said collet finger end of said release sleeve moves, and said first means not holding said upper slip housing in said first position when the collet finger end of said release sleeve does not contact the collet finger end of said release mandrel.

11. The anchor apparatus of claim 8, wherein said lower slip housing has an upset, and wherein said second means comprises:

a release piston having an upset, said frangible member supporting said release piston in one position when said frangible member is in said intact condition;

a slip release having a collet finger end, said collet finger end of said slip release adapted to contact said upset of said lower slip housing; and a release pin adapted to be disposed between said upset of said release piston and said collet finger end of said slip release, the collet finger end of said slip release contacting said upset of said lower slip housing when said release pin is disposed between said upset of said release piston and said collet finger end of said slip release, said second means holding said lower slip housing in said second position when said collet finger end of said slip release contacts said upset of said lower slip housing.

12. The anchor apparatus of claim 11, wherein said frangible member releases the support to said release piston in said one position when said frangible member changes to said shattered condition in response to the detonation wave passing through said frangible member, said upset of said release piston moving when the frangible member releases the support to said release piston, said release pin not being disposed between said upset of said release piston and said collet finger end of said slip release when said upset of said release piston moves, the collet finger end of said slip release not contacting said upset of said lower slip housing when said release pin is not disposed between said upset of said release piston and said collet finger end of said slip release, said second means not holding said lower slip housing in said second position when said collet finger end of said slip release is not contacting said upset of said lower slip housing.

13. The anchor apparatus of claim 10, wherein said lower slip housing has an upset, and wherein said second means comprises:

a release piston having an upset, said frangible member supporting said release piston in one position when said frangible member is intact;

a slip release having a collet finger end, said collet finger end adapted to contact said upset of said lower slip housing; and a release pin adapted to be disposed between said upset of said release piston and said collet finger end of said slip release, the collet finger end of said slip release contacting said upset of said lower slip housing when said release pin is disposed between said upset of said release piston and said collet finger end of said slip release, said second means holding said lower slip housing in said second position when said collet finger end of said slip release contacts said upset of said lower slip housing.

14. The anchor apparatus of claim 13, wherein said frangible member releases the support to said release piston in said one position when said frangible member changes to said shattered condition in response to the detonation wave passing through said frangible member, said upset of said release piston moving when the frangible member releases the support to said release piston, said release pin not being disposed between said upset of said release piston and said collet finger end of said slip release when said upset of said release piston moves, the collet finger end of said slip release not contacting said upset of said lower slip housing when said release pin is not disposed between said upset of said release piston and said collet finger end of said slip release, said second means not holding said lower slip housing in said second position when said collet finger end of said slip release is not contacting said upset of said lower slip housing.

15. A method of unsetting an anchor and releasing a tool from a wall of a wellbore, comprising the steps of:

propagating a detonation wave through a detonating cord, a frangible member comprised of a cast iron material enclosing said detonating cord;

propagating said detonation wave in said detonating cord through an interior of said frangible member:

shattering said frangible member in response to the propagation of said detonation wave through said interior of said frangible member; and unsetting said anchor when the frangible member shatters.

16. The method of claim 15, wherein the unsetting step comprises the step of:

releasing a slip housing, the anchor being unset when the slip housing is released.

17. The method of claim 16, wherein the releasing step comprises the step of:

removing a support from a release piston when the frangible member shatters and moving said release piston when the support is removed; and moving a collet finger end of a slip release away from an upset of said lower slip housing, said slip housing being released when the collet finger end of said slip release is moved away from said upset of said slip housing.

18. An apparatus for unsetting an anchor of a wellbore tool adapted to be disposed in a wellbore, comprising:

a frangible member adapted to shatter said frangible member being comprised of a cast iron material:

means disposed within an interior space of said frangible member for shattering the cast iron material of said frangible member; and means operatively associated with the frangible member and responsive to the shattering of said frangible member for unsetting said anchor when the frangible member shatters.

19. The apparatus of claim 18, wherein the means for shattering includes a detonating cord adapted for conducting a detonation wave and disposed within said interior space of said frangible member, the cast iron material of said frangible member shattering in response to the detonation wave conducting in said detonating cord and passing through the interior space of said frangible member.

20. The apparatus of claim 19, wherein said anchor includes an upper slip housing and a lower slip housing, and wherein the means for unsetting said anchor comprises:

first means for holding the upper slip housing in a first position a secondary unsetting of said anchor being prevented when said first means holds the upper slip housing in said first position;

second means for holding the lower slip housing in a second positions a primary unsetting of said anchor being prevented when said second means holds said lower slip housing in said second position; and third means for releasing the hold by said second means on said lower slip housing when said lower slip housing is disposed in said second position.

21. The apparatus of claim 20, wherein the means for unsetting said anchor comprises:

fourth means for releasing the hold by said first means on said upper slip housing when said third means did not release the hold by said second means on said lower slip housing and said upper slip housing is disposed in said first position.

22. The apparatus of claim 21, wherein said third means comprises said frangible member, said frangible member having an interior space and being comprised of a cast iron material, the means for shattering including a detonating cord adapted for conducting a detonation wave and disposed within said interior space of said frangible member, the frangible member shattering in response to the detonation wave propagating through said frangible member, and the frangible member releasing the hold by said second means on said lower slip housing when said frangible member shatters in response to the detonation wave passing through said frangible member, the anchor being unset when the frangible member releases the hold by said second means on said lower slip housing.

23. Wellbore apparatus adapted to be disposed in a wellbore, comprising:

anchor apparatus adapted to grip a wall of said wellbore, said anchor apparatus including, an upper slip housing;

a lower slip housing; and an anchor slip disposed between the upper slip housing and the lower slip housing and adapted to expand to grip said wall of said wellbore when said upper slip housing approaches said lower slip housing;

holding means for holding said lower slip housing in a fixed position, said holding means including, a frangible member comprised of a cast iron material and having an interior space, said frangible member having an intact condition and a shattered condition, and detonation wave conducting means disposed within said interior space of said frangible member for conducting a detonation wave, said holding means holding said lower slip housing in said fixed position when said frangible member is in said intact condition; and means for pushing said upper slip housing toward said lower slip housing when said holding means holds said lower slip housing in said fixed position, said anchor slip expanding to grip said wall of said wellbore when said means for pushing pushes said upper slip housing toward said lower slip housing simultaneously with the holding by said holding means of said lower slip housing in said fixed position.

24. The wellbore apparatus of claim 23, wherein said frangible member changes from said intact condition to said shattered condition when said detonation wave conducting means conducts said detonation wave through said interior space of said frangible member, said holding means failing to hold said lower slip housing in said fixed position when said frangible member changes to said shattered condition, said lower slip housing moving away from said upper slip housing when said holding means fails to hold said lower slip housing in said fixed position, said anchor slip retracting and releasing the grip from said wall of said wellbore when said lower slip housing moves away from said upper slip housing.

25. The wellbore apparatus of claim 24, further comprising:

further holding means for holding said upper slip housing in a fixed position when said frangible member is in said intact condition and said anchor slip grips said wall of said wellbore.

26. The wellbore apparatus of claim 25, further comprising:

release means for releasing the hold by said further holding means of said upper slip housing in said fixed position when said frangible member is in said intact condition and said anchor slip grips said wall of said wellbore, said anchor slip retracting and releasing the grip from said wall of said wellbore when said release means releases the hold by said further holding means of said upper slip housing in said fixed position.

27. A method of setting and unsetting an anchor disposed on a wellbore apparatus when said wellbore apparatus is disposed in a wellbore, said anchor including an upper slip housing, a lower slip housing, and an anchor slip disposed between the upper slip housing and the lower slip housing, comprising the steps of:

holding, by a frangible member, said lower slip housing in a fixed position;

pushing said upper slip housing toward said lower slip housing when said wellbore apparatus is disposed in said wellbore;

expanding said anchor slip in response to the pushing step, the anchor slip gripping a wall of said wellbore in response to the expanding step, the anchor being set when said anchor slip grips said wall of said wellbore:

further holding said upper slip housing in a fixed position following the expanding step;

conducting a detonation wave in a detonating cord, said detonating cord being disposed within a hollow interior of said frangible member, said frangible member being in an intact condition and being comprised of a cast iron material;

shattering the cast iron material of said frangible member in response to the detonation wave in said detonating cord propagating through the hollow interior of said frangible member, said frangible member changing from said intact condition to a shattered condition in response to the shattering step:

releasing the hold, by said frangible member, of said lower slip housing in said fixed position in response to the shattering step: and retracting said anchor slip from the grip on said wall of said wellbore in response to the releasing step, the anchor being unset when said anchor slip is retracted.

28. The method of claim 27, wherein said anchor further includes a release sleeve having a fishing profile, further comprising the steps of:

when said frangible member is in said intact condition, attaching a shifting tool to said fishing profile of said release sleeve;

when said shifting tool is attached to said fishing profile of said release sleeve, moving said release sleeve;

further releasing said upper slip housing from said fixed position which was attained during the further holding step in response to the moving step; and retracting said anchor slip and releasing the grip on said wall of said wellbore in response to the further releasing step, said anchor being unset when said anchor slip is retracted.

29. A wellbore tool adapted to be disposed in a wellbore including an anchor apparatus for setting and unsetting an anchor, said anchor apparatus comprising:

an upper slip housing;

a lower slip housing;

an anchor slip disposed between the upper and lower slip housings and adapted to expand radially outwardly when the upper slip housing approaches the lower slip housing, said anchor being set when said anchor slip is expanded radially outwardly;

a primary anchor release mechanism adapted to firmly hold one of the slip housings and to retain said anchor set when not activated and to release said one of the slip housings and to unset said anchor when activated;

a secondary anchor release mechanism adapted to firmly hold the other of the slip housings and to retain said anchor set when the primary and secondary anchor release mechanisms are not activated and to release said other of the slip housings and to unset said anchor when the secondary anchor release mechanism is activated, said upper slip housing approaching said lower slip housing and expanding said anchor slip radially outwardly when the primary anchor release mechanism firmly holds said one of the slip housings and the secondary anchor release mechanism firmly holds said other of the slip housings, the anchor being set when the anchor slip grips a wall of said wellbore;

top sub means connected to one of the slip housings for connecting with a first part of a setting tool, said top sub means being adapted to move in response to a movement of said first part of said setting tool; and connection means connected to the other of the slip housings for connecting with a second part of said setting tool, said connection means adapted to remain fixed in position, said upper slip housing approaching said lower slip housing and said anchor slip expanding radially outwardly thereby setting said anchor when said top sub means moves in response to a movement of said first pan of said setting tool and said connection means remains fixed in position.

30. The wellbore tool of claim 29, further including a firing head disposed within said anchor apparatus, a detonating cord connected to said firing head adapted for propagating a detonation wave, and a perforating gun connected to said anchor apparatus and said detonating cord, said perforating gun detonating in response to said detonation wave.

31. The wellbore tool of claim 30, wherein said primary anchor release mechanism comprises:

a frangible member having an interior space, said detonating cord being disposed within said interior space of said frangible member, said frangible member shattering in response to said detonation wave propagating in said detonating cord and passing through the interior space of said frangible member, said lower slip housing being released when said frangible member shatters, said primary anchor release mechanism being activated and said anchor being unset when said lower slip housing is released.

32. The wellbore tool of claim 31, wherein a large opening is defined through a center of said connection means when said top sub means continues to move in response to a movement of said first part of said setting tool and said connection means continues to remain fixed in position, and wherein said secondary anchor release mechanism comprises:

a release sleeve connected to said upper slip housing and including a shifting profile adapted to attach to a shifting tool, said shifting tool moving said release sleeve when said shifting tool is attached to said shifting profile, said release sleeve being disconnected from said upper slip housing when said release sleeve is moved in response to the movement of said shifting tool, said secondary anchor release mechanism being activated and said anchor being unset when said primary anchor release mechanism is not activated and said release sleeve is disconnected from said upper slip housing.

* * * * *